US011427428B2

(12) United States Patent
Furumido et al.

(10) Patent No.: US 11,427,428 B2
(45) Date of Patent: Aug. 30, 2022

(54) MEDIUM DISCHARGING DEVICE, POST-PROCESSING DEVICE AND RECORDING APPARATUS

(71) Applicant: SEIKO EPSON CORPORATION, Tokyo (JP)

(72) Inventors: Tsuyoshi Furumido, Shiojiri (JP); Shota Hiramatsu, Shiojiri (JP); Katsuyuki Kondo, Shiojiri (JP); Chiaki Shimada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 61 days.

(21) Appl. No.: 17/062,873

(22) Filed: Oct. 5, 2020

(65) Prior Publication Data

US 2021/0101771 A1 Apr. 8, 2021

(30) Foreign Application Priority Data

Oct. 7, 2019 (JP) ..... JP2019-184347

(51) Int. Cl.
*B65H 33/08* (2006.01)
*B65H 31/36* (2006.01)

(52) U.S. Cl.
CPC ..... *B65H 33/08* (2013.01); *B65H 31/36* (2013.01); *B65H 2301/421* (2013.01)

(58) Field of Classification Search
CPC .. B65H 33/08; B65H 31/36; B65H 2301/421; B65H 31/3036; B65H 31/3018; B65H 31/3027; B65H 31/02; B65H 2404/7412; B65H 2301/4212; B65H 2405/114; B65H 2405/11151; B65H 2801/27; B65H 2301/4213
See application file for complete search history.

(56) References Cited

U.S. PATENT DOCUMENTS

2015/0014913 A1* 1/2015 Obuchi ..... G03G 15/6544 270/58.12
2015/0014916 A1* 1/2015 Saito ..... B65H 31/34 271/185
2015/0183606 A1* 7/2015 Nishi ..... B65H 31/02 271/234
2015/0225200 A1 8/2015 Yamashita et al.

FOREIGN PATENT DOCUMENTS

JP 2015-151228 A 8/2015

* cited by examiner

*Primary Examiner* — Gregory W Adams
(74) *Attorney, Agent, or Firm* — Workman Nydegger

(57) ABSTRACT

A medium discharging device includes a side cursor, a moving unit, a discharge unit, and a side guide. The side cursor is provided in a processing tray and is provided movable in an intersecting direction intersecting a discharging direction of the medium, aligns an end portion of a media bundle in the intersecting direction, and guides the media bundle in the discharging direction when the media bundle is discharged. The moving unit moves the side cursor in the intersecting direction. The discharge unit discharges the media bundle from the processing tray to the discharge tray where the media bundle is placed. When the media bundle is discharged, the side guide is disposed alongside the side cursor in the discharging direction and restricts movement of the media bundle in the intersecting direction, which is discharged by the discharger.

11 Claims, 16 Drawing Sheets

MEDIUM DISCHARGING DEVICE, POST-PROCESSING DEVICE AND RECORDING APPARATUS

The present application is based on, and claims priority from JP Application Serial Number 2019-184347, filed Oct. 7, 2019, the disclosure of which is hereby incorporated by reference herein in its entirety.

BACKGROUND

1. Technical Field

The present disclosure relates to a medium discharging device that discharges a medium, a post-processing device that includes the medium discharging device, and a recording apparatus that includes the post-processing device.

2. Related Art

A device including a medium discharging device that discharges a medium such as a sheet is known in the related art, and an example thereof is disclosed in JP-A-2015-151228. A post-processing device described in JP-A-2015-151228 includes a stapler and a paper bundle shifter that shifts a paper bundle loaded on a tray in a direction orthogonal to a discharging direction, and moves the stapler, and at the same time, moves the paper bundle shifter in the direction opposite to the moving direction of the stapler. The paper bundle after the post-processing is discharged to a discharge tray.

As in a configuration in JP-A-2015-151228, in the configuration in which the media bundle is discharged to the discharger after the post-processing is performed on the media bundle, when the media bundle swells due to moisture or the like, a degree of swelling in the intersecting direction intersecting the discharging direction may vary. In this case, the media bundle may be skewed with respect in the discharging direction due to a partial difference in the transportation force in the discharging by the discharger.

SUMMARY

According to an aspect of the present disclosure, a medium discharging device includes: a guide member that is movably, in an intersecting direction, provided in an accumulation portion in which a plurality of media are accumulated, the intersecting direction intersecting a discharging direction in which the media are discharged from the accumulation portion, aligns an end portion of a media bundle in the intersecting direction, the media bundle being made of the plurality of the media, and guides the media bundle in the discharging direction when the media bundle is discharged; a movement portion that moves the guide member in the intersecting direction; a discharger that discharges the media bundle from the accumulation portion to a placement portion where the media bundle is placed; and a restriction member that is disposed downstream in the discharging direction with respect to the accumulation portion, is disposed alongside the guide member in the discharging direction when the media bundle is discharged, and restricts movement of the media bundle in the intersecting direction, the media bundle being discharged by the discharger.

DESCRIPTION OF EXEMPLARY EMBODIMENTS

Figure 1:
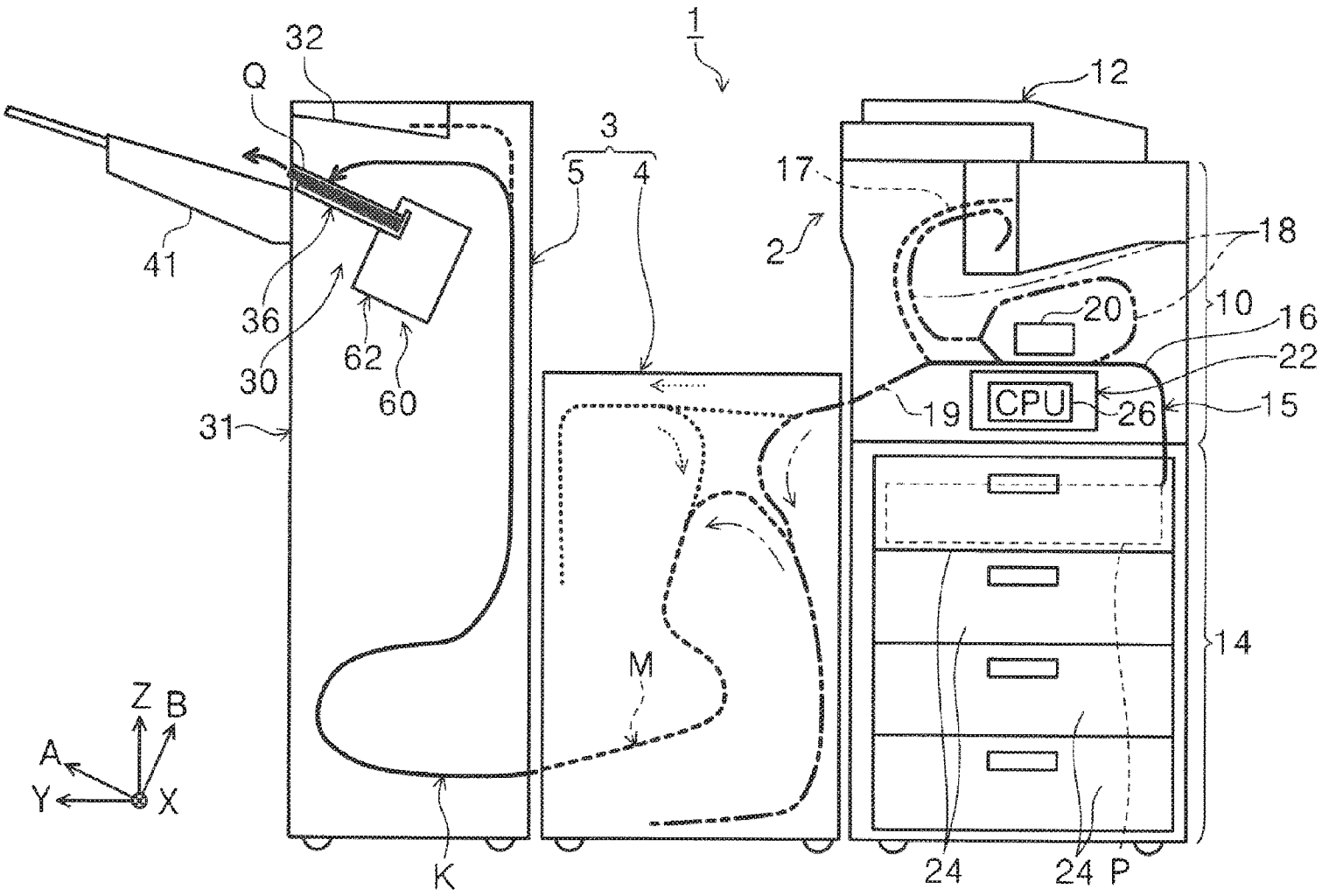
FIG. 1 is a schematic diagram of a recording system.

Hereinafter, the present disclosure will be briefly described.

According to a first aspect of the present disclosure, a medium discharging device includes: a guide member that is movably, in an intersecting direction, provided in an accumulation portion in which a plurality of media are accumulated, the intersecting direction intersecting a discharging direction in which the media are discharged from the accumulation portion, aligns an end portion of a media bundle in the intersecting direction, the media bundle being made of the plurality of the media, and guides the media bundle in the discharging direction when the media bundle is discharged; a movement portion that moves the guide member in the intersecting direction; a discharger that discharges the media bundle from the accumulation portion to a placement portion where the media bundle is placed; and a restriction member that is disposed downstream in the discharging direction with respect to the accumulation portion, is disposed alongside the guide member in the discharging direction when the media bundle is discharged, and restricts movement of the media bundle in the intersecting direction, the media bundle being discharged by the discharger.

When swelling occurs due to moisture or the like, since a degree of swelling of the media bundle in the accumulation portion differs in the intersecting direction, there is a possibility of skewing with respect in the discharging direction when the discharge is performed by the discharger.

According to the aspect, the restriction member is disposed alongside the guide member and the discharging direction. Here, when the discharger discharges the media bundle toward the placement portion, even if the media bundle may skew with respect in the discharging direction, the restriction member is disposed alongside the guide member in the discharging direction and the movement of the media bundle in the intersecting direction is restricted, it is possible to suppress the skew of the media bundle.

In the medium discharging device in a second aspect, the guide member according to the first aspect may be provided on one side and the other side in the intersecting direction with respect to the media bundle.

According to the aspect, when the movement portion moves the guide member in the intersecting direction, the one side of the end portion and the other side of the end portion of the media bundle in the intersecting direction come in contact with on one side and the other side of the guide member in the intersecting direction. In this way, the media bundle is suppressed from being displaced and disposed with respect to the guide member, it is possible to suppress the positional displacement of the media bundle in the accumulation portion with respect to the scheduled discharge start position.

In the medium discharging device in a third aspect, the accumulation portion according to the first aspect or the second aspect may be provided with a plurality of aligning members that are arranged at an interval in the intersecting direction and align an end portion of the media bundle upstream in the discharging direction, and the movement portion may move the media bundle in the intersecting direction so that the end portion of the media bundle in the intersecting direction is displaced from any of the aligning members in the intersecting direction.

When the movement portion moves the media bundle in the intersecting direction after aligning the end portion of the media bundle upstream in the discharging direction using the aligning member, the end portion of the media bundle in the intersecting direction is displaced in the intersecting direction with respect to the aligning member. Since the contact portion of the media bundle with the aligning member are biased due to this "displacement", the media bundle tends to skew, but according to the aspect, the restriction member restricts the movement of the media bundle in the intersecting direction, it is possible to suppress the skew of the media bundle.

In the medium discharging device in a fourth aspect, the medium discharging device according to any one of the first aspect to the third aspect may further include a driving portion that moves the restriction member in the intersecting direction.

According to the aspect, by moving the restriction member in the intersecting direction using the driving portion, since the surface of the restriction member at the media bundle side can be close to the surface of the guide member of the media bundle side. Therefore, it is possible to reduce the amount of displacement between the restriction member and the guide member in the intersecting direction.

In addition, when moving the guide member in the intersecting direction by the movement portion, since the restriction member can be moved to the same direction as the guide member by the driving portion, it is possible to suppress the posture of the media bundle from tilting when moving in the intersecting direction.

In the medium discharging device in the fifth aspect, the driving portion according to the fourth aspect may perform driving for causing the restriction member to approach a set position at which the restriction member is positioned alongside the guide member after the discharger starts to discharge the media bundle and an end portion of the media bundle downstream in the discharging direction reaches a position of an end portion of the restriction member, the position being upstream in the discharging direction.

According to the aspect, when using the media bundle having a relatively short length in the discharging direction, the restriction member is moved so that the driving portion is aligned with the guide member after the discharge of the media bundle is started. In this way, since it becomes difficult for the downstream end portion of the short media bundle in the discharging direction to be caught in a part of the restriction member, it is possible to suppress the defective discharge of the media bundle compared to the configuration in which the restriction member is aligned with the guide member before the discharge of the media bundle.

In the medium discharging device in the sixth aspect, the driving portion according to the fourth aspect or the fifth aspect may move the restriction member according to a position of the end portion of the media bundle in the intersecting direction.

According to the aspect, since the driving portion moves the restriction member according to the position of the end portion, the restriction member can be disposed along the side edge of the media bundle. In this way, a gap is less likely to occur between the discharged media bundle and the restriction member, it is possible to further suppress the skew of the media bundle.

In the medium discharging device in the seventh aspect the restriction member according to any one of the fourth aspect to the sixth aspect may be provided with a support portion that supports the media bundle from below.

According to the aspect, in a state in which the restriction member restricts the media bundle from moving in the intersecting direction, since the support portion supports the media bundle, it is possible to suppress the skew of the media bundle in a stable state in which the media bundle is supported by the support portion. In addition, it is possible to suppress the media bundle from falling due to its own weight.

In the medium discharging device in the eighth aspect, the support portion according to the seventh aspects may be positioned above the placement portion. When the movement portion moves the guide member in the intersecting direction, the restriction member and the support portion are configured to move in the intersecting direction by the driving portion interlocked with the movement of the guide member. The driving portion may change a support state of the media by the support portion to a non-support state after the media bundle is discharged from the accumulation portion onto the support portion, and may drop the media bundle onto the placement portion.

According to the aspect, when the movement portion moves the guide member in the intersecting direction, the restriction member and the support portion are movable by the driving portion in the intersecting direction interlocked with the movement of the guide member. In this way, when the guide member moves the media bundle sent to the accumulation portion in the intersecting direction, if the tip side of the media bundle in the discharging direction has a length that can be supported by the support portion, since the support portion is also moved in the intersecting direction interlocked with the movement of the guide member, it becomes possible to perform the shift movement of the media bundle in the intersecting direction in a state in which the posture of the media bundle is less likely to be disturbed.

Then, after the shift movement performed as described above, since the media bundle is discharged in the discharging direction while being restricted from moving in the intersecting direction by the restriction member, and discharged onto the support portion from the accumulation portion, it is possible to suppress the skew of the media bundle.

By changing the support state of the media bundle by the support portion to the non-support state and dropping the media bundle onto the placement portion, it is possible to suppress the position of the media bundle placed in the placement portion from being displaced.

In the medium discharging device in the ninth aspect, the restriction member according to any one of the first aspect to the eighth aspect may include a first restriction member that comes in contact with one end portion of the media bundle in the intersecting direction, and a second restriction member that comes in contact with the other end portion of the media bundle in the intersecting direction.

According to the aspect, since the first restriction member and the second restriction member are in contact with the portions at both sides of the media bundle in the intersecting direction, and the displacement of the media bundle in the intersecting direction is restricted, it is possible to suppress the skew of the media bundle compared to the configuration without any one of the first restriction member and the second restriction member.

In the medium discharging device in the tenth aspect, the restriction member according to any one of the first aspect to the ninth aspect may be disposed so as to come in contact with a side edge of the media bundle opposite to a side of the discharger with respect to a center of the media bundle in the intersecting direction after movement by the movement portion.

According to the aspect, when the discharger discharges the media bundle in a state in which the discharger is biasedly disposed in the intersecting direction with respect to the media bundle, at the discharger side of the media bundle in the intersecting direction, the force to discharge the media bundle in the discharging direction is stronger than that of at the side opposite to the discharger side. Therefore, the media bundle tends to skew toward the opposite side when discharged by the discharger.

Here, since the restriction member comes in contact with the side edge at the opposite side of the discharger side of the media bundle, the movement of the media bundle to the side opposite to the discharger side is restricted. Therefore, it is possible to suppress the skew of the media bundle caused by the biased dispose of the discharger.

A post-processing device according to an eleventh aspect includes the medium discharging device according to the first aspect to the tenth aspect, and a post-processor that is provided in the accumulation portion of the medium discharging device and performs post-processing on the media bundle in the accumulation portion. The movement portion moves the media bundle to one side in the intersecting direction, and the post-processor performs binding processing on an end portion on the one side of the media bundle that was moved to the one side.

According to the aspect, the post-processor performs the post-processing on the media bundle. In this case, in the media bundle, since the peripheral portion of the portion where the post-processing is performed may be in a swelled state compared to the portion where the post-processing is not performed, in the discharge operation by the discharger, the load that acts on the portion where the post-processing is performed is larger than the load that acts on the portion where the post-processing is not performed. As a result, the media bundle tends to skew in the direction of rotation with the portion where the post-processing is performed as a center. Here, since the restriction member restricts the movement of the media bundle in the intersecting direction, when discharging the media bundle after the post-processing is performed, it is possible to suppress the skew of the media bundle.

A recording apparatus according to a twelfth aspect includes a recording portion that records information in a medium; and the post-processing device according to the eleventh aspect that accumulates a plurality of the media where the information is recorded by the recording portion in the accumulation portion to form the media bundle, and performs the post-processing on the media bundle.

According to the aspect, in the recording apparatus, it is possible to obtain the same operational effect as that of the post-processing device described in the eleventh aspect.

Embodiment 1

Hereinafter, an embodiment 1 as one embodiment of a medium discharging device, a post-processing device, and a recording apparatus according to the present disclosure will be described in detail with reference to accompanying drawings. In the XYZ coordinate system illustrated in each drawing, the X-axis direction is the device depth direction, the Y-axis direction is the device width direction, and the Z-axis direction is the device height direction. When distinguish a depth side from a near side in the device depth direction, the depth side is referred to as +X side and the near side is referred to as −X side. When distinguishing a left side from a right side in the device width direction, the left side is referred to as +Y side and the right side is referred to as −Y side. When distinguishing an upper side from a lower side in the device height direction, the upper side is referred to as +Z side and the lower side is referred to as −Z side.

Outline of Recording System

In FIG. 1, a recording system 1 is illustrated as an example of a recording apparatus. FIG. 1 is a front view of the recording system 1. The recording system 1 includes a recording unit 2 and a post-processing unit 3 as an example of a post-processing device in order from the right side to the left side in FIG. 1. The recording system 1 is configured such that the recording unit 2 and the post-processing unit 3 are mechanically and electrically coupled to each other, and a medium P can be transported from the recording unit 2 to the post-processing unit 3.

An operator (not illustrated) can perform various operations from the −X side, which is the near side of the recording system 1. The recording system 1 is provided with an operation panel (not illustrated) operated by the operator. The operation panel is configured to input various settings for the recording unit 2 and the post-processing unit 3. In addition, the operation panel can be provided in the recording unit 2 as an example. The recording system 1 is configured to perform post-processing described later on the medium P on which information is recorded by a printer portion 10 described later. In the recording system 1, the same operational effects as those of the post-processing unit 3 described later can be obtained.

Recording Unit

The recording unit 2 records various kinds of information on the medium P being transported. As the medium P, for example, sheet-shaped paper is used. The various information recorded on the medium P includes character information and image information. In addition, the recording unit 2 also includes the printer portion 10, a scanner portion 12, and a cassette accommodation portion 14.

The printer portion 10 is an example of a recording portion, and is configured to include a line head 20 and a controller 22.

The line head 20 is configured as a so-called ink jet recording head that records various information on the medium P by ejecting an ink, which is an example of liquid, onto the medium P.

The controller 22 is configured to include a central processing unit (CPU) 26, a read only memory (ROM), a random access memory (RAM), and a storage (not illustrated), can controls operations such as transporting the medium P and recording various information on the medium P in the recording unit 2. In addition, the controller 22 can control not only the recording unit 2 but also the various operations in the post-processing unit 3.

The scanner portion 12 reads the information in a manuscript (not illustrated). The information in the manuscript read by the scanner portion 12 is stored in a memory of the controller 22.

The cassette accommodation portion 14 includes a plurality of accommodation cassettes 24 that accommodate the medium P. A transport path 15 for transporting the medium P is formed in the printer portion 10 and the cassette accommodation portion 14.

The transport path 15 includes a paper feed path 16, a discharge path 17, an inversion path 18 and a delivery path 19 as an example. In addition each section of the transport path 15 is provided with a pair of transport rollers (not illustrated). In the transport path 15, the medium P is transported from the accommodation cassette 24 to a recording area of the line head 20, and further transported from the recording area to the post-processing unit 3.

Post-Processing Unit

The post-processing unit 3 includes an intermediate unit 4 that transports the medium P received from the recording unit 2 and an end unit 5 that performs the post-processing on the required number of media P received from the intermediate unit 4. In the present embodiment, the "post-processing" means processing performed on the media P on which the information is recorded in recording unit 2. A specific example of the "post-processing" will be described later. The post-processing unit 3 accumulates a plurality of media P on which the information is recorded in the printer portion 10, in a processing tray 36 described later to form a media bundle Q, and performs the post-processing on the media bundle Q. In the post-processing unit 3, the same operational effects as that of the end unit 5 described later can be obtained.

Intermediate Unit

The intermediate unit 4 is a unit that transports the medium P received from the recording unit 2 and transfers the medium to the end unit 5. In the intermediate unit 4, a transport path M formed of a plurality of paths through which the medium P received from the recording unit 2 is transported is formed. In the transport path M, a plurality of pairs of transport roller (not illustrated) is provided. In addition, the transport path M is formed so that the medium P is switched back in any one of the two paths. The intermediate unit 4 may be removed and the medium P may be directly transported from the recording unit 2 to the end unit 5.

End Unit

The end unit 5 includes a medium discharger 30 as an example of the medium discharging device, and a processor 60 that performs post-processing on a media bundle Q formed of a plurality of media P. Specifically, the end unit 5 is configured to include a medium discharger 30 and a processor 60, and a housing 31 as a device body. The housing 31 is configured to include an upper tray 32 and a discharge tray 41 on which the medium P is placed. A transport path K for transporting the medium P from the intermediate unit 4 is formed in the housing 31.

The media P that are not processed by the processor 60 are discharged to the upper tray 32. The media P processed by the processor 60 are discharged to the discharge tray 41.

The discharge tray 41 is an example of a placement portion, and extends from the housing 31 to the +Y side. In addition, the discharge tray 41 is disposed at a position at the +Y side and the −Z side with respect to the +Y side end portion of the processing tray 36 described later.

In the description below, as an example, the width direction of the medium P and the media bundle Q is the X-axis direction. In addition, the width direction of the end unit 5 when viewing the end unit 5 from the X axis direction is the Y axis direction. In addition, an intersecting direction that intersects the width direction of the media bundle Q placed on the processing tray 36 described later is referred to as an A-axis direction. The A-axis direction is, for example, a direction orthogonal to the X-axis direction and a direction intersecting the Y-axis direction. In addition, the A-axis direction is a direction inclined so that the +Y side is higher than the −Y side when viewed from the X-axis direction. A direction orthogonal to the X-axis direction and the A-axis direction is referred to as a B-axis direction.

Medium Discharger

Figure 2:
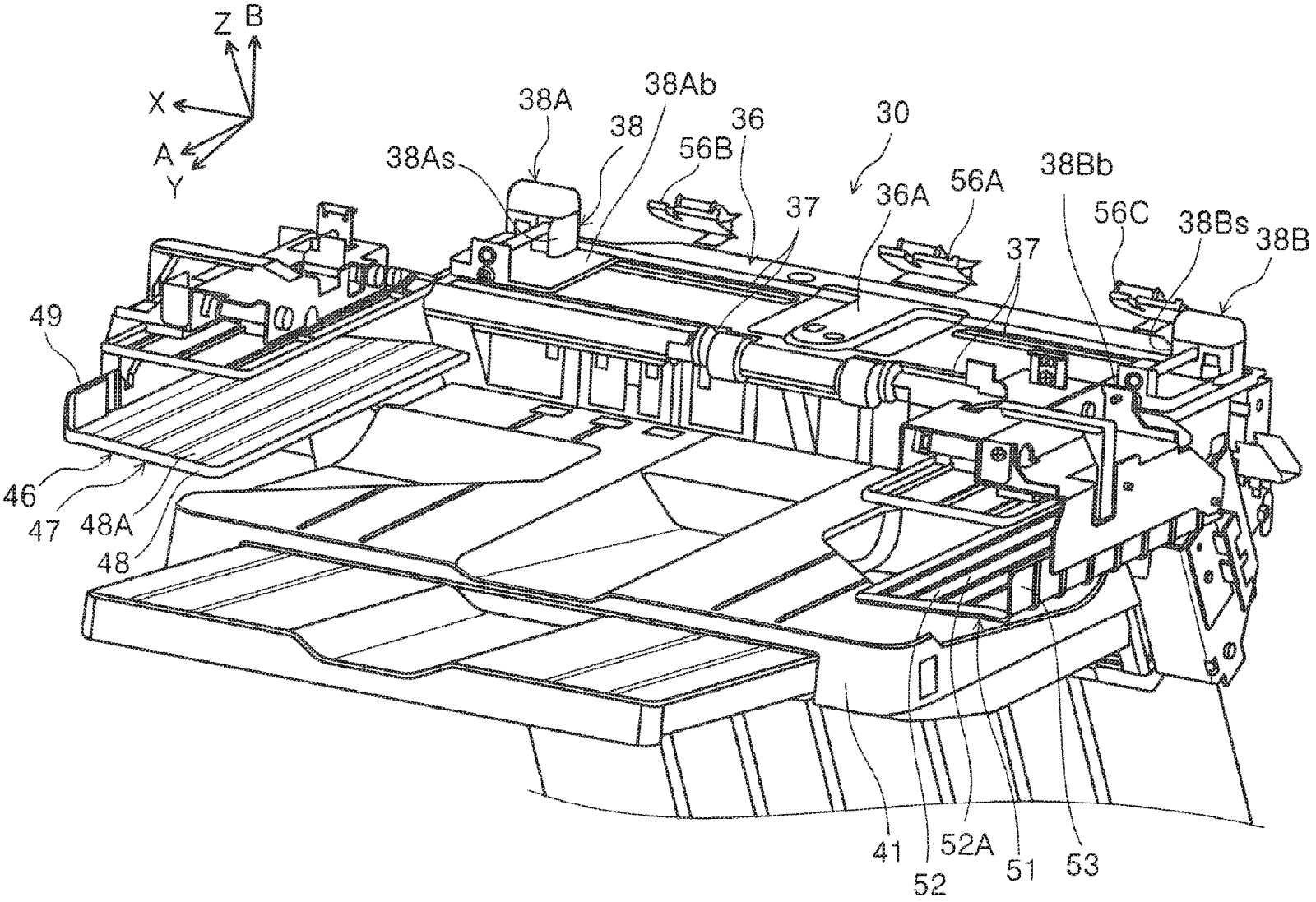
FIG. 2 is a perspective view illustrating an internal structure of an end unit according to an embodiment 1.

The medium discharger 30 illustrated in FIG. 2 includes a processing tray 36, a side cursor 38 provided on the processing tray 36, a moving unit 40 (FIG. 5) that moves the side cursor 38, and a discharge unit 42 that discharges the media bundle Q. (FIG. 3) and a side guide 46. Furthermore, the medium discharger 30 includes an alignment plate 56A, an alignment plate 56B, and an alignment plate 56C as an example of an aligning member.

Processing Tray

The processing tray 36 is an example of an accumulation portion, and a plurality of media P are accumulated. Specifically, the processing tray 36 is formed in a flat plate shape having the X-axis direction as the width direction. In addition, the processing tray 36 extends in the A-axis direction with the B-axis direction as the thickness direction so that the position of +Y side end portion is positioned at the +Z side of the position of −Y side end portion. The width of the processing tray 36 in the X-axis direction is wider than the width of the medium P in the X-axis direction.

Here, a plurality of media P is accumulated on the processing tray 36 by a plurality of media P being sequentially placed on an upper surface 36A, which is a +Z side surface of the processing tray 36, and being stacked in the B-axis direction, and thus, the media bundle Q (FIG. 1) is formed.

In addition, in the processing tray 36, a guide slit 37 extending linearly in the X-axis direction and penetrating in the B-axis direction is formed.

Side Cursor

The side cursor 38 is an example of a guide member, and is configured with a first cursor 38A and a second cursor 38B positioned on both sides of the medium P or the media bundle Q in the X-axis direction.

A part of the first cursor 38A and a part of the second cursor 38B are inserted into the guide slit 37, respectively, and are movable along the guide slit 37 in the X-axis direction. In other words, the first cursor 38A and the second cursor 38B are movably provided in the processing tray 36 in the X-axis direction as the intersecting direction intersecting the A-axis direction as the discharging direction of the medium P.

In addition, the first cursor 38A and the second cursor 38B are automatically movable in the X-axis direction by being operated by the moving unit 40 (FIG. 5) described later.

The first cursor 38A includes a bottom plate portion 38Ab that supports a side edge portion of the media bundle Q at the +X side, and a side plate portion 38As that holds the side edge portion from the side direction. The bottom plate portion 38Ab and the side plate portion 38As extend in the A-axis direction, respectively. A length of the side plate portion 38As in the A-axis direction is, for example, shorter than a length of the bottom plate portion 38Ab in the A-axis direction.

The second cursor 38B includes a bottom plate portion 38Bb that supports the side edge portion of the media bundle Q on the −X side, and a side plate portion 38Bs that holds the side edge portion from the side direction. The bottom plate portion 38Bb and the side plate portion 38Bs extend in the A-axis direction, respectively. A length of the side plate portion 38Bs in the A-axis direction is, for example, shorter than a length of the bottom plate portion 38Bb in the A-axis direction.

The side plate portion 38As and the side plate portion 38Bs are respectively disposed so as to be in contact with the media bundle Q at two locations with a space in the A-axis direction, however, in the description below, the side plate portion 38As and the side plate portion 38Bs will be illustrated and described as one plate-shaped portion for the sake of easier understanding.

The first cursor 38A and the second cursor 38B align both end portions of the medium P or media bundle Q in the X-axis direction, which are stacked on the processing tray 36. In addition, the first cursor 38A and the second cursor 38B move the media bundle Q to the X-axis direction by moving to the X-axis direction while pinching the medium P or the media bundle Q in the X-axis direction. In addition, the first cursor 38A and the second cursor 38B are in contact with the side of the media bundle Q along the A-axis direction when the media bundle Q is discharged by the discharge unit 42 described later, and guides the media bundle Q to the A-axis direction.

Moving Unit

Figure 5:
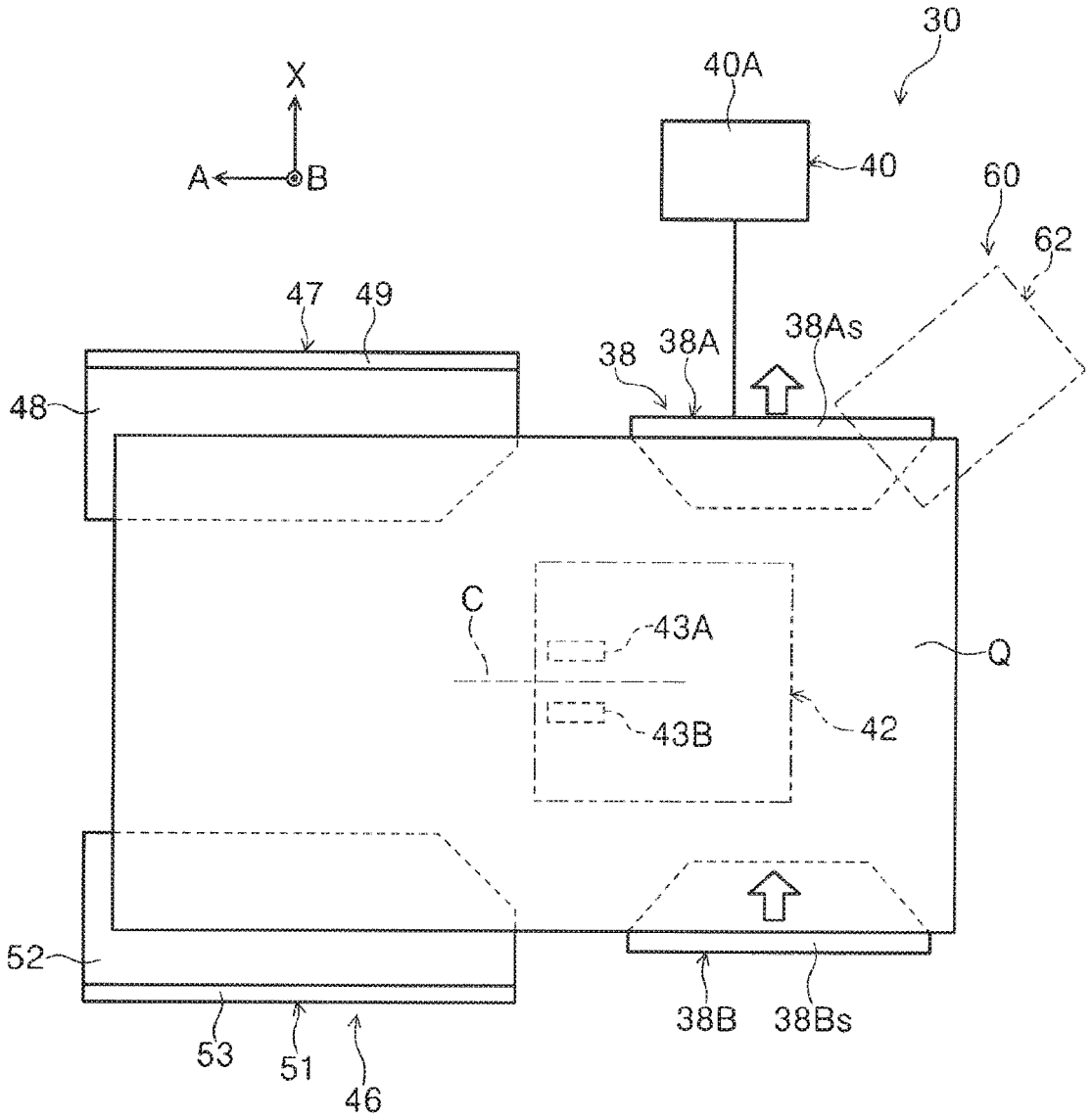
FIG. 5 is a diagram for explaining an operation in the embodiment 1.

The moving unit 40 illustrated in FIG. 5 is configured to include a cursor movement portion 40A as an example of a movement portion, and a controller 22 (FIG. 1) that controls the operation of the cursor movement portion 40A. The cursor movement portion 40A includes a motor and a gear (not illustrated).

The moving unit 40 is configured to move the side cursor 38 in the X-axis direction by the CPU 26 (FIG. 1) operating the cursor movement portion 40A based on the program set in the controller 22.

Specifically, when performing the post-processing on the media bundle Q, by moving the side cursor 38 to the X-axis direction from the initial position, the moving unit 40 makes the media bundle Q be in a state of being pinched, and then, moves the media bundle Q in the +X side by moving the side cursor 38 to the +X side. In the state in which the side sensor 38 is moved, the position of the side guide 46 is set in advance so that the side plate portion 38As and the vertical wall portion 49 of the side guide 46 described later are disposed at the same position in the X-axis direction.

Discharge Unit

Figure 3:
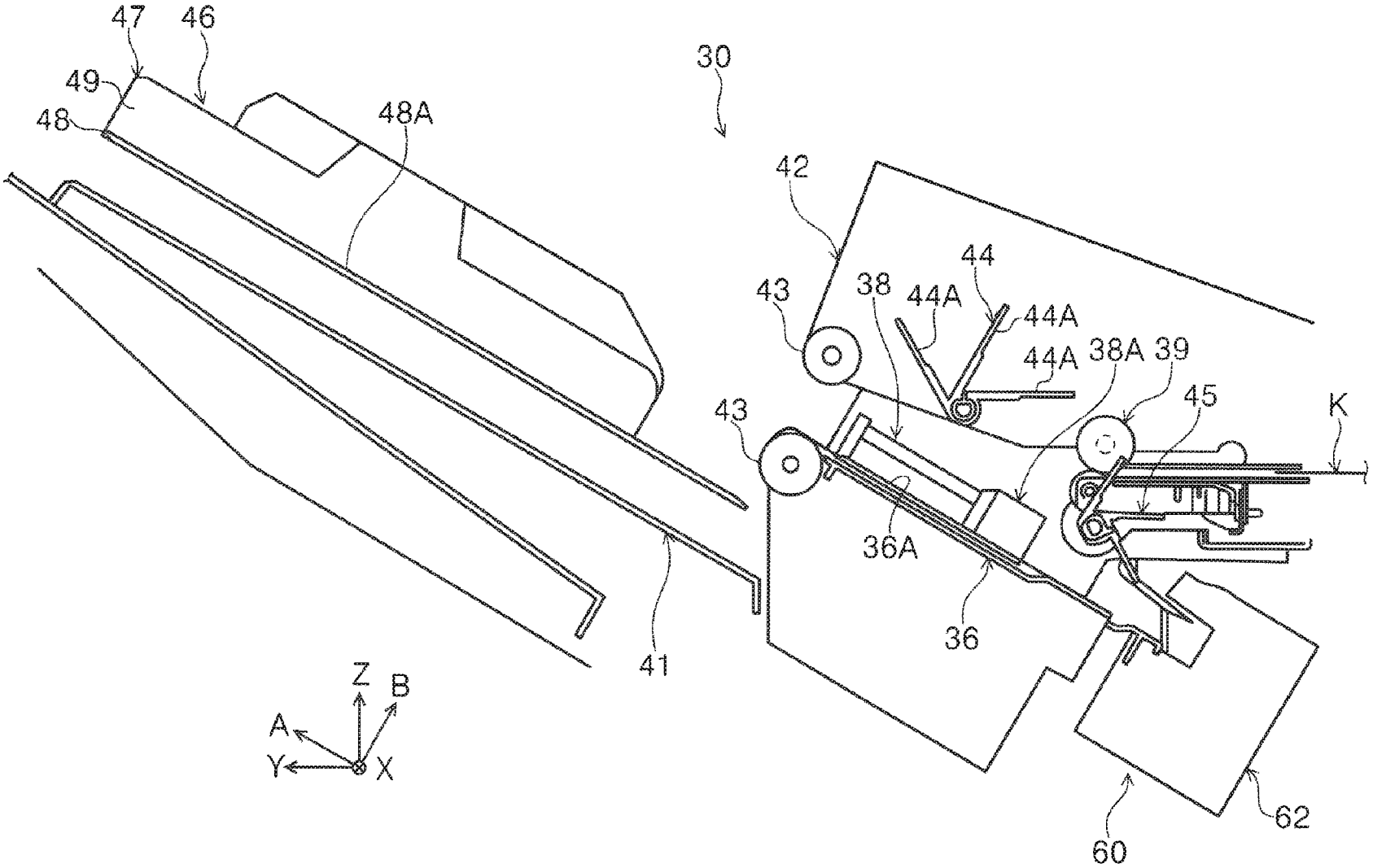
FIG. 3 is a perspective view illustrating an internal structure of the end unit according to the embodiment 1.

The discharge unit 42 illustrated in FIG. 3 is an example of a discharger, and is disposed at the +Z side with respect to the processing tray 36. In addition, the discharge unit 42 includes, for example, one roller of a pair of delivery rollers 43 and a paddle 44. One roller of the discharge unit 42 and the other roller of the pair of delivery rollers 43 disposed on the processing tray 36 are configured to discharge the media bundle Q (FIG. 1) to the discharge tray 41. In the present embodiment, the discharge of the media bundle Q to the discharge tray 41 means that the media bundle Q is discharged at least above the discharge tray 41. That is, the discharge of the media bundle Q to the discharge tray 41 includes not only limited to the case where the media bundle Q is placed on the discharge tray 41, but also includes a case where the media bundle Q is supported by the side guide 46 described below at the position above the discharge tray 41.

The pair of delivery rollers 43 is disposed at the center position in the X-axis direction, at the +A side end portion of the processing tray 36 and at the +Y side with respect to the paddle 44 described later. In addition, the pair of delivery rollers 43 is provided so as can rotate with the X-axis direction as an axial direction, and is rotationally driven by a driving portion (not illustrated). Then, since at least one of the pair of delivery rollers 43 is driven by the driving portion, the media bundle Q on the processing tray 36 is rotated and discharged toward the discharge tray 41.

The pair of delivery rollers 43 includes a roller 43A and a roller 43B space apart in the X-axis direction. Here, an imaginary line passing through a midpoint between the roller 43A and the roller 43B in the X-axis direction and extending in the Y-axis direction is referred to as a center line C (FIG. 5).

The paddle 44 is provided at the +Z side with respect to the processing tray 36 so as to be rotatable with the X-axis direction as the axial direction. In addition, the rotation and stop of the paddle 44 are controlled by a driving portion (not illustrated) and the controller 22 (FIG. 1). As an example, the paddle 44 includes three rubber blades 44A, and the rubber blades come in contact with the medium P while rotating, and thus the medium P on the processing tray 36 is sent toward the processor 60.

When discharging the media bundle Q from the processing tray 36 toward the discharge tray 41, as an example, the pair of delivery rollers 43 may function mainly and the paddle 44 may function as a subordinate.

A pair of transport rollers 39 that transport the medium P toward the processing tray 36, and a delivery paddle 45 that sends the medium P or the media bundle Q to the processor 60 described later are provided upstream of the paddle 44 in the transport path K.

Side Guide

The side guide 46 illustrated in FIG. 2 is an example of a restriction member, and is disposed at the +Z side above the discharge tray 41. In addition, as an example, the side guide 46 includes a first side guide 47 that is disposed at the +X side with respect to the center of the discharge tray 41 in the X-axis direction, and a second side guide 51 that is disposed on the −X side with respect to the center of the discharge tray 41 in the X-axis direction.

In other words, the side guides 46 are provided on one side and the other side of the media bundle Q in the X-axis direction (FIG. 1). In the embodiment 1, embodiment 2 and embodiment 3, only the first side guide 47 functions as an example of the restriction member. In the description below, one side of the X-axis direction is the +X side and the other side is the −X side.

As an example, the first side guide 47 and the second side guide 51 are disposed so as to be line-symmetrical with respect to a virtual line (not illustrated) passing through the center of the discharge tray 41 in the X-axis direction and along the Y-axis direction. Therefore, in the description below, only one of the first side guide 47 and the second side guide 51 will be described, and the description for the other side may be omitted.

The first side guide 47 and the second side guide 51 are respectively provided so as can be moved to the X-axis direction to a support position for supporting the medium P on the discharge tray 41 and a retraction position for dropping the medium P onto the discharge tray 41. In the description in the embodiment 1, the first side guide 47 and the second side guide 51 maintain the support position and do not move to the X-axis direction, except when the medium P is dropped onto the discharge tray 41.

The first side guide 47 includes a plate-shaped support portion 48 which is long in the A-axis direction and having the B-axis direction as a thickness direction, and a vertical wall portion 49 which stands upright on +Z side at the +X side end portion of the support portion 48. In other words, the first side guide 47 includes the vertical wall portion 49, and the support portion 48 is provided on the first side guide 47. The size of the support portion 48 is such a size that the +X side end portion of the media bundle Q can be supported.

The +Z side surface of the support portion 48 is referred to as an upper surface 48A. The length of the vertical wall portion 49 in the A-axis direction is set to a length so as not to come in contact with the first cursor 38A when the first cursor 38A is moved in the X-axis direction. The height of the vertical wall portion 49 is set to such a height that the media bundle Q can be held in the X-axis direction.

The second side guide 51 includes a plate-shaped support portion 52 that is long in the A-axis direction and having the B-axis direction as the thickness direction, and a vertical wall portion 53 that stands upright on +Z side at the −X side end portion of the support portion 52. In other words, the second side guide 51 includes the vertical wall portion 53, and the support portion 52 is provided on the second side guide 51. The size of the support portion 52 is such a size that the end portion of the media bundle Q on the −X side can be supported.

The +Z side surface of the support portion 52 is referred to as an upper surface 52A. The length of the vertical wall portion 53 in the A-axis direction is set to a length so as not to come in contact with the second cursor 38B when the second cursor 38B is moved to the X-axis direction. The height of the vertical wall portion 53 is set such a height that the media bundle Q can be held in the X-axis direction.

Figure 4:
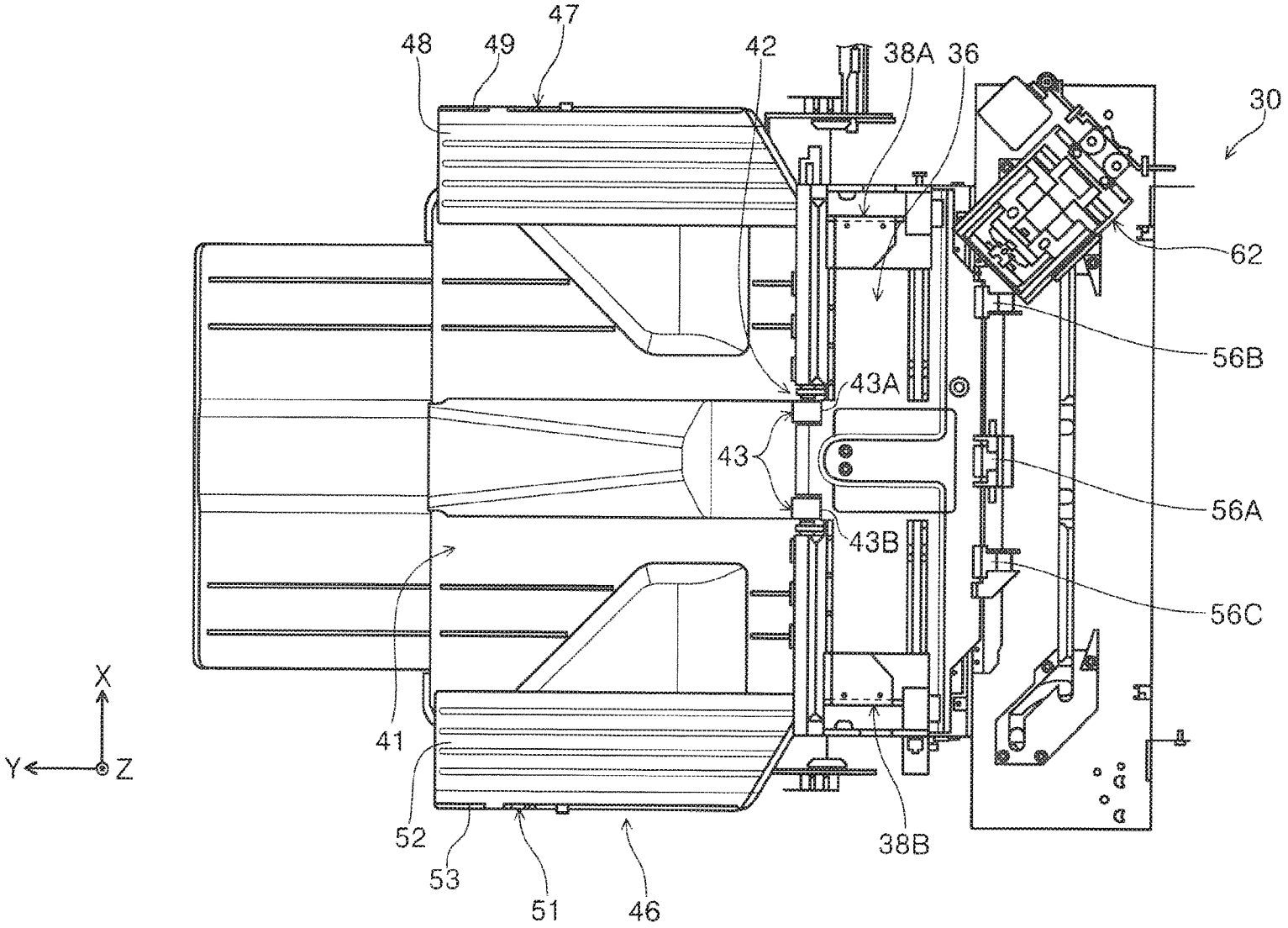
FIG. 4 is a plan view illustrating the internal structure of the end unit in the embodiment 1.

As illustrated in FIG. 4, for example, when viewed from the Z direction, the shape of the support portion 48 is a rectangular shape which is long in the Y direction and short in the X direction, and in which a corner at the +X side and the −Y side thereof is cut out. The description of the shape of the support portion 52 will be omitted.

As illustrated in FIG. 3, the −A side end portion of the upper surface 48A is positioned closer to the −B side than the +A side end portion of the upper surface 36A. In addition, the support portion 48 is disposed so as to be tilted along the A-axis direction which is a direction intersecting the Y-axis direction so that the +A side end portion is positioned closer to the +Z side than the −A side end portion.

Figure 6:
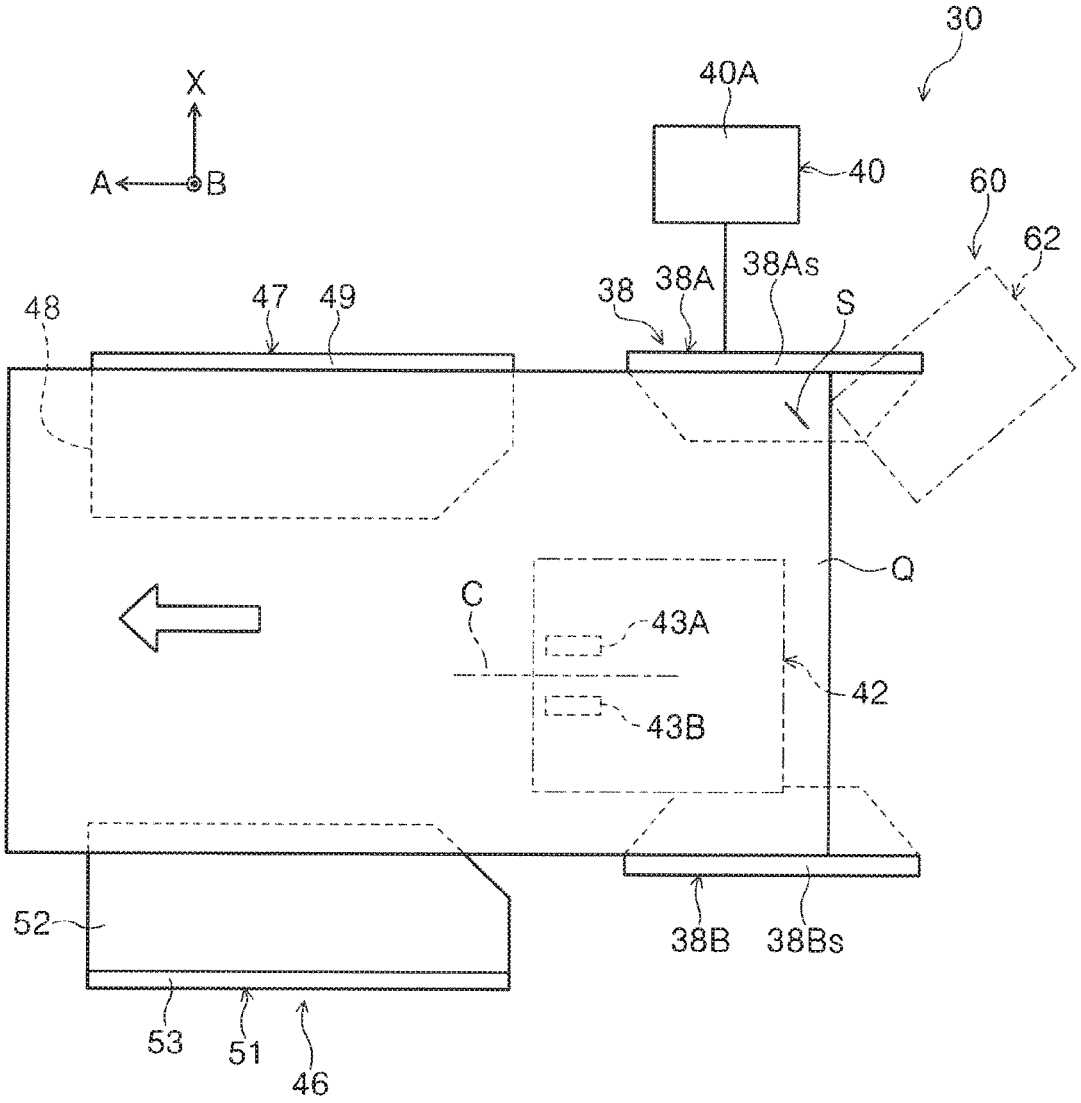
FIG. 6 is a diagram for explaining the operation in the embodiment 1.

As illustrated in FIG. 4, the first side guide 47 is disposed alongside the first cursor 38A in the A-axis direction, and is configured to restrict the movement of the media bundle Q discharged by the discharge unit 42 in the X-axis direction. In addition, as illustrated in FIG. 6, the first side guide 47 is disposed so as to come in contact with the side edge (side surface) opposite to the pair of delivery rollers 43 side of the discharge unit 42 with respect to the center (position indicated by a white arrow) in the X-axis direction of the media bundle Q after moving by the moving unit 40 (FIG. 5). In other words, the first side guide 47 is disposed so as to come into contact with the side edge (side surface) of the side far from the above-described center line C in the X-axis direction of the media bundle Q.

Figure 8:
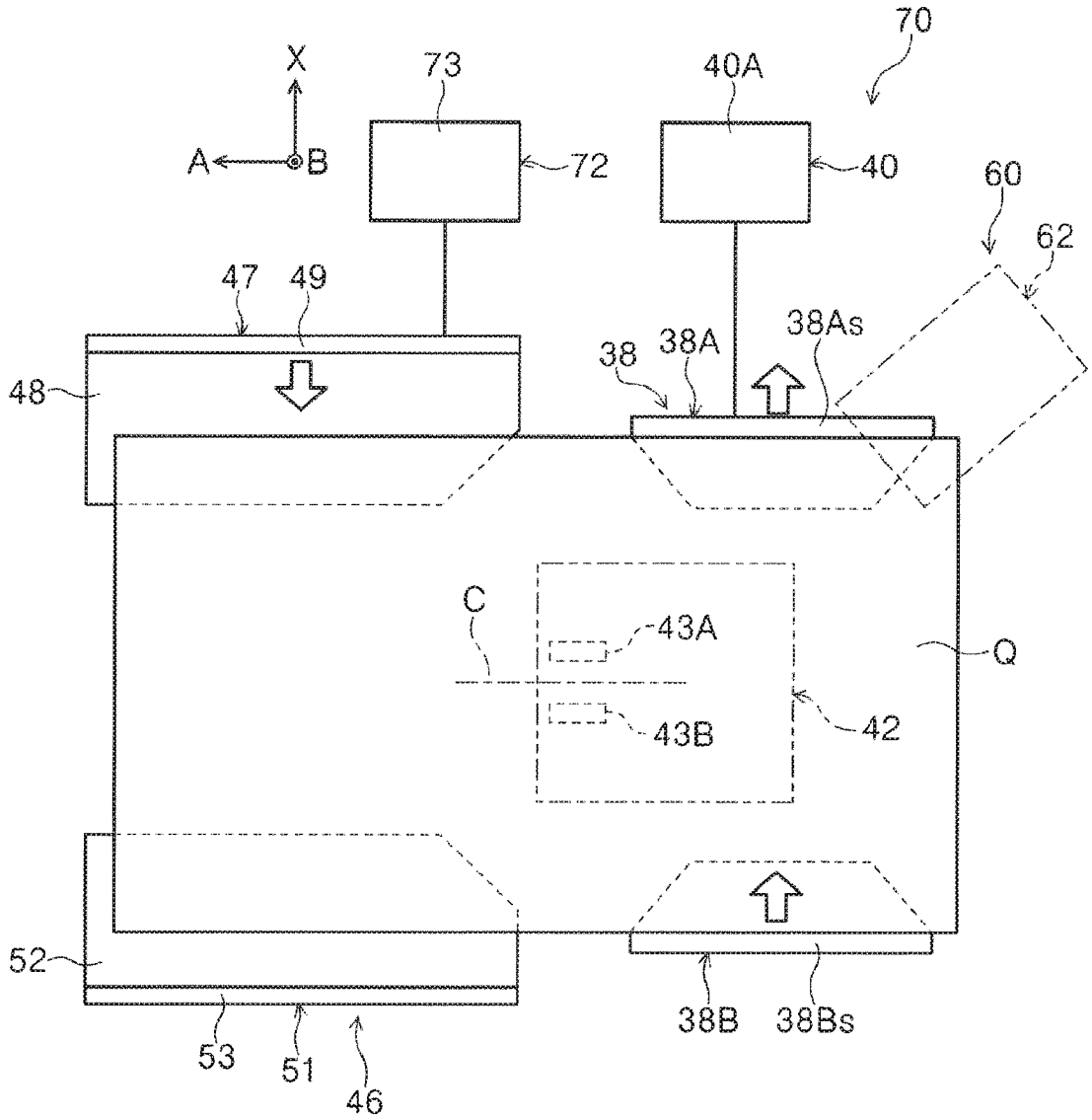
FIG. 8 is a diagram for explaining an operation in an embodiment 2.

In the present embodiment, a driving portion that moves the side guide 46, which is a restriction member, in the X-axis direction when dropping the medium P onto the discharge tray 41 is provided. Here, the driving portion is not illustrated but corresponds to a drive unit 72 described later (FIG. 8).

The support portion 48 is positioned above the discharge tray 41 which is the placement portion. After the media bundle Q is discharged from the accumulation portion processing tray 36 onto the support portions 48 and 52, the support state of the media bundle Q is changed by the support portions 48 and 52 to the non-support state, and the media bundle Q is dropped onto the discharge tray 41.

Alignment Plate

As illustrated in FIG. 2 and FIG. 3, the alignment plate 56A, the alignment plate 56B, and the alignment plate 56C are provided in the X-axis direction at an interval at the −A side end portion of the processing tray 36 in the A-axis direction. The alignment plate 56A, the alignment plate 56B, and the alignment plate 56C are configured to align the +A side end portion which is upstream of the media bundle Q in the A-axis direction at the time of discharge, by coming in contact with the media bundle Q.

Processor

The processor 60 illustrated in FIG. 3 is an example of a post-processor. In addition, the processor 60 is provided in the processing tray 36 and performs post-processing on the media bundle Q in the processing tray 36. Specifically, the processor 60 is configured to include a stapler 62, a motor (not illustrated), and the controller 22 (FIG. 1).

The stapler 62 is movable in the X-axis direction by driving a motor. In addition, by controlling the operation using the controller 22 (FIG. 1), the stapler 62 performs end binding processing on the aligned end portion of the media bundle Q. The end binding processing is an example of the post-processing. In the present embodiment, as an example, the stapler 62 performs the end binding processing on the +X side and −Y side corners of the media bundle Q.

Descriptions on Operation and Effects of Embodiment 1

Figure 7:
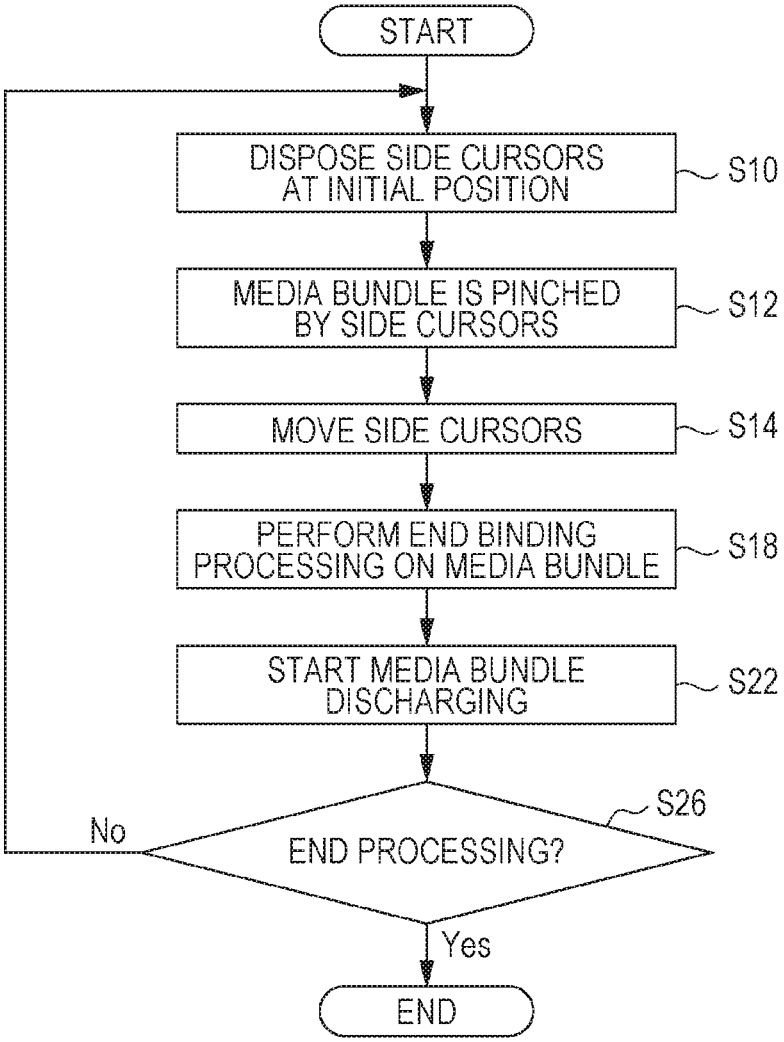
FIG. 7 is a diagram for explaining the operation in the embodiment 1.

The medium discharger 30, the post-processing unit 3 and the recording system 1 in the embodiment 1 will be described mainly with reference to FIG. 5, FIG. 6 and FIG. 7. FIG. 5 and FIG. 6 mainly illustrate the positional relationship between the side cursor 38, the side guide 46, and the media bundle Q as a schematic diagram. FIG. 7 is a flowchart illustrating a flow of the post-processing and the discharge processing performed on the media bundle Q by the controller 22 (FIG. 1). In the description using FIG. 7, the individual drawing number for the reference numerals of each member will be omitted.

Each processing illustrated in FIG. 7 is performed by the CPU 26 reading a processing program from the ROM or the storage, deploying the processing program in the RAM, and executing the processing program.

In STEP S10, the CPU 26 disposes the first cursor 38A and the second cursor 38B at the initial position (FIG. 4). After the first cursor 38A and the second cursor 38B are disposed at the initial position, it is assumed that a plurality of media P are transported to the processing tray 36 and the media bundle Q is formed. Then, the process proceeds to STEP S12.

In STEP S12, the CPU 26 operates the cursor movement portion 40A to move the first cursor 38A and the second cursor 38B from the initial position according to the size of the media bundle Q. In this way, the first cursor 38A and the second cursor 38B pinches the media bundle Q in the X-axis direction and aligns the position of the end portion of the media bundle Q in the X-axis direction. Then, the process proceeds to STEP S14.

In STEP S14, the CPU 26 moves the first cursor 38A and the second cursor 38B to the +X side to the position where the end binding processing by the stapler 62 is can be performed (FIG. 5). At this time, the side surface of the side plate portion 38As at the −X side and the side surface of the vertical wall portion 49 at the −X side are disposed at the same position in the X-axis direction. Then, the process proceeds to STEP S18.

In STEP S18, the CPU 26 causes the stapler 62 to operate to the +X side and to perform the end binding processing on the media bundle Q. Then, the process proceeds to STEP S22. In this case, in the media bundle Q, a portion where the end binding is performed by a staple needle S (FIG. 6) and a peripheral portion thereof may be in a swelled state compared to other portions where the end binding is not performed. Therefore, in the discharge operation by the discharge unit 42, the load that acts on the portion where the end binding processing is performed is larger than the load that acts on the portion where the end binding processing is not performed. As a result, the media bundle Q tends to skew in the direction of rotation with the portion where end binding processing is performed as a center.

In addition, since the media bundle Q is moved to the +X side, the center position of the media bundle Q and the position of the pair of delivery rollers 43 are displaced in the X-axis direction. As a result, since the transport force applied to the media bundle Q is biasedly applied, the media bundle Q tends to skew. As long as the media bundle Q is to be moved to the X-axis direction and be discharged, the skew of the media bundle Q due to the bias of the transport force can also occur even when the end binding processing is not performed.

In STEP S22, the CPU 26 operates the discharge unit 42 to start discharging the media bundle Q. Here, if the media bundle Q is in a state of skewing with respect to the A-axis direction because the transport speed is different between the +X side and the −X side of the media bundle Q due to the above-described swell and the bias of transport force, since the side surface of the side plate portion 38As at the −X side and the side surface of the vertical wall portion 49 at the −X side are disposed at the same position in the X-axis direction, the movement of the media bundle Q to the +X side is restricted by the vertical wall portion 49. As a result, it is possible to suppress the skew of the media bundle Q (FIG. 6). Then, the process proceeds to STEP S26.

In STEP S26, the CPU 26 determines whether there is next processing or not. That is, it is determined whether the next media bundle Q is formed and the discharge processing is to be performed, or the processing is ended now.

When ending the processing (Yes in STEP S26), the CPU 26 ends the program. On the other hand, when performing the next process (No in STEP S26), the CPU 26 makes the process proceed to STEP S10.

1. To summarize the above description, according to the embodiment 1, the side guide 46 is disposed alongside the side cursor 38 in the A-axis direction. Here, when the discharge unit 42 discharges the media bundle Q toward the discharge tray 41, even if the media bundle Q may skew with respect to the A-axis direction, the side guide 46 is disposed alongside the side cursor 38 in the A-axis direction and the movement of the media bundle Q to the X-axis direction is restricted, it is possible to suppress the skew of the media bundle Q.

2. According to the embodiment 1, when the moving unit 40 moves the side cursor 38 to the X-axis direction, the one side of the end portion and the other side of the end portion of the media bundle Q in the X-axis direction are in contact with one side of the first cursor 38A and the other side of the second cursor 38B in the X-axis direction. In this way, the media bundle Q is suppressed from being displaced and disposed with respect to the side cursor 38, it is possible to suppress the positional displacement of the media bundle Q in the processing tray 36 with respect to the scheduled discharge start position.

3. According to the embodiment 1, in a state in which the side cursor 38 restricts the media bundle Q from moving to the X-axis direction, if the media bundle Q is discharged toward the discharge tray 41, since the support portion 48 and the support portion 52 support the media bundle Q, it is possible to suppress the skew of the media bundle Q in a stable state in which the media bundle Q is supported by the support portions 48 and 52. In addition, it is possible to suppress the media bundle Q from falling due to its own weight.

4. According to the embodiment 1, when the discharge unit 42 discharges the media bundle Q in a state in which the discharge unit 42 is biasedly disposed in the X-axis direction with respect to the media bundle Q, at the discharge unit 42 side (−X side) of the media bundle Q in the X-axis direction, the force to discharge the media bundle Q in the A-axis direction is stronger than that of at the side opposite to the discharge unit 42 side (+X side, and may be simply referred to as the opposite side hereinafter). Therefore, the media bundle Q tends to skew toward the opposite side when discharged by the discharge unit 42.

Here, since the side cursor 38 and the side guide 46 are in contact with the side edge of the media bundle Q at the opposite side, the movement of the media bundle Q to the opposite side is restricted. Therefore, it is possible to suppress the skew of the media bundle Q caused by the biased dispose of the discharge unit 42.

Embodiment 2

Figure 9:
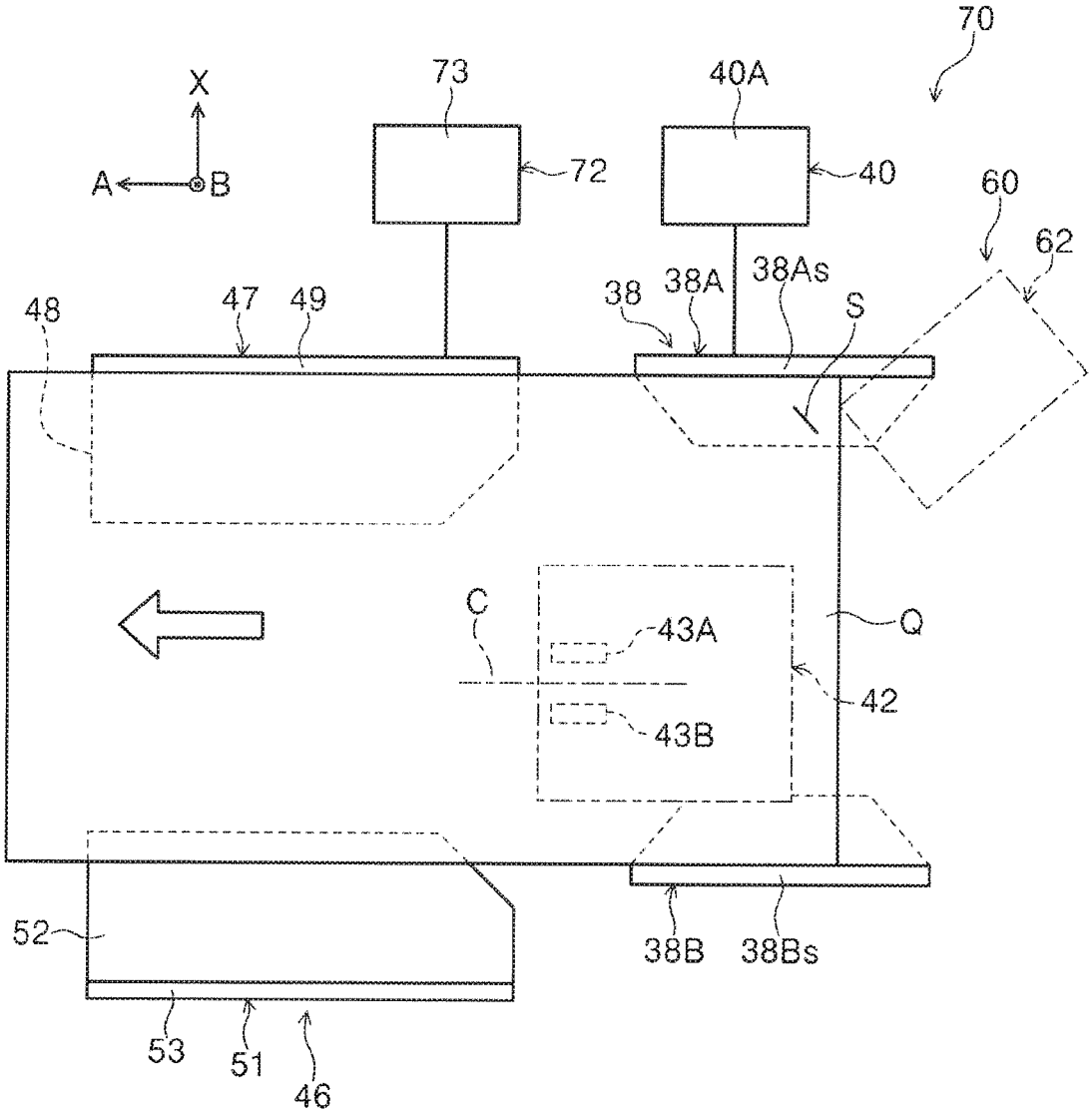
FIG. 9 is a diagram for explaining the operation in the embodiment 2.

Next, a medium discharging device, a post-processing device, and a recording apparatus according to an embodiment 2 of the present disclosure will be described based on FIGS. 8 to 10. The same reference numerals will be given to the same parts as those of the embodiment 1, and the description thereof will be omitted. In addition, the description of the operations and effects same as those in the embodiment 1 will be omitted.

As illustrated in FIG. 8, in the present embodiment 2, the medium discharger 70 is provided in place of the medium discharger 30 (FIG. 1) in the post-processing unit 3 (FIG. 1). The medium discharger 70 includes a drive unit 72.

The drive unit 72 is configured to include a guide driving portion 73 as an example of a driving portion and a controller 22 (FIG. 1) that controls the driving of the guide driving portion 73. The guide driving portion 73 includes a motor and gears which are not illustrated.

In the drive unit 72, the CPU 26 (FIG. 1) controls the driving of the guide driving portion 73 based on the program set in the controller 22, and thus, the first side guide 47 is moved in the X-axis direction. In the present embodiment, the drive unit 72 does not drive the second side guide 51.

Specifically, the drive unit 72 is configured to move the first side guide 47 to a set position set in advance when the first cursor 38A and the second cursor 38B are moved to a position where the staple processing can be performed on the media bundle Q, and after the staple processing is performed, and before the media bundle Q is discharged.

The set position means that the side surface of the side plate portion 38As at the −X side of the first cursor 38A and the side surface of the vertical wall portion 49 at the −X side of the first side guide 47 are the same position in the X-axis direction.

As described above, the drive unit 72 moves the side guide 46 to the X-axis direction so that the side cursor 38 and the side guide 46 are at the same position in the X-axis direction and are aligned in the A-axis direction.

Descriptions on Operation and Effects of Embodiment 2

The medium discharger 70, the post-processing unit 3 and the recording system 1 in the embodiment 2 will be described mainly with reference to FIG. 8, FIG. 9 and FIG. 10. FIG. 8 and FIG. 9 mainly illustrate the positional relationship between the side cursor 38, the side guide 46, and the media bundle Q as a schematic diagram. FIG. 10 is a flowchart illustrating a flow of the post-processing and the discharge processing performed on the media bundle Q by the controller 22 (FIG. 1). In the description using FIG. 10, the individual drawing number for the reference numerals of each member will be omitted.

Figure 10:
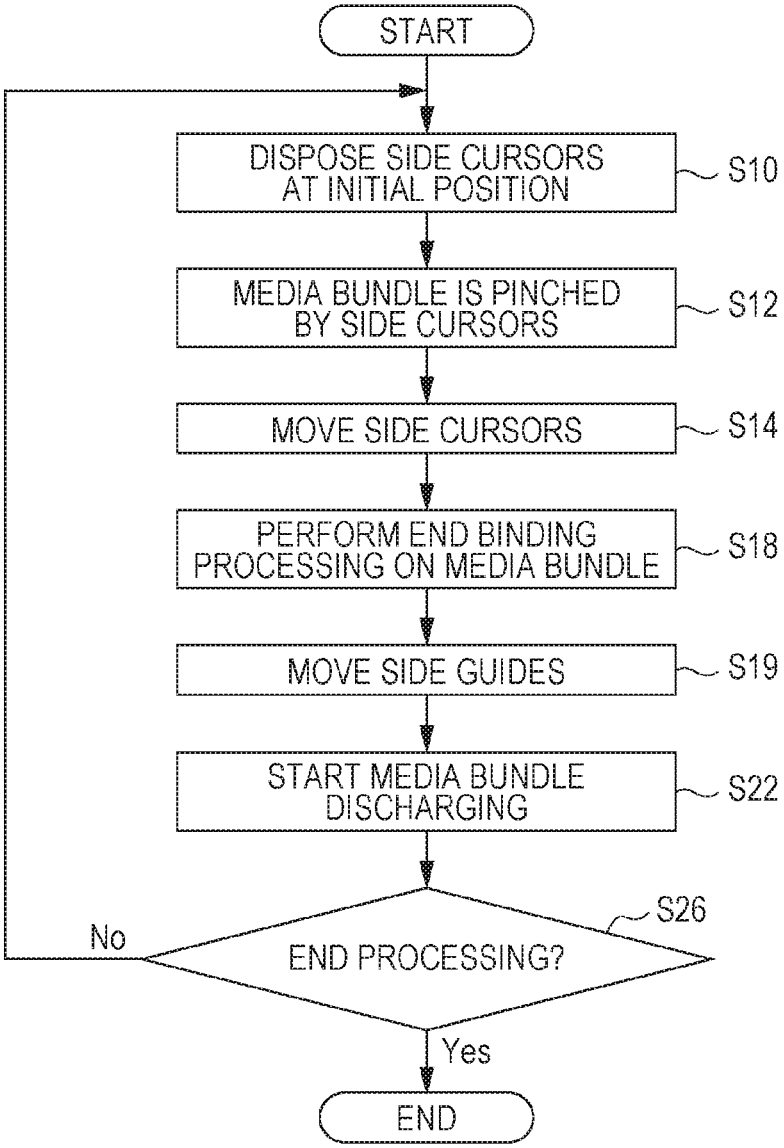
FIG. 10 is a flowchart of the embodiment 2.

Each processing illustrated in FIG. 10 is performed by the CPU 26 reading a processing program from the ROM or the storage, deploying the processing program in the RAM, and executing the processing program. Steps of the same operations as in the embodiment 1 are denoted by the same step reference numerals as in the embodiment 1, and the description thereof will be omitted.

After STEP S18 ends, the process proceeds to STEP S19.

In STEP S19, the CPU 26 operates the guide driving portion 73 to move the first side guide 47 from the initial position to the set position. As a result, the side plate portion 38As of the first cursor 38A and the vertical wall portion 49 of the first side guide 47 are disposed at the same position in the X-axis direction. Then, the process proceeds to STEP S22.

As described above, according to the embodiment 2, by moving the first side guide 47 in the X-axis direction using the guide driving portion 73 of the drive unit 72, since the first side guide 47 approach closer to the first cursor 38A compared to the case where the first side guide 47 is not moved, it possible to reduce the amount of displacement between the first side guide 47 and the first cursor 38A in the X-axis direction. In addition, since the position of the side guide 46 can be moved, the side guide 46 can be disposed at a position suitable for the media having various width sizes, and thus, it is possible to suppress the skew of the media bundle Q discharged at the appropriate position.

Embodiment 3

Next, a medium discharging device, a post-processing device, and a recording apparatus according to an embodiment 3 of the present disclosure will be described based on FIGS. 11 to 13. The same reference numerals will be given to the same parts as those of the embodiment 1 or the embodiment 2, and the description thereof will be omitted. In addition, the description of the operations and effects same as those in the embodiment 1 or the embodiment 2 will be omitted.

Figure 11:
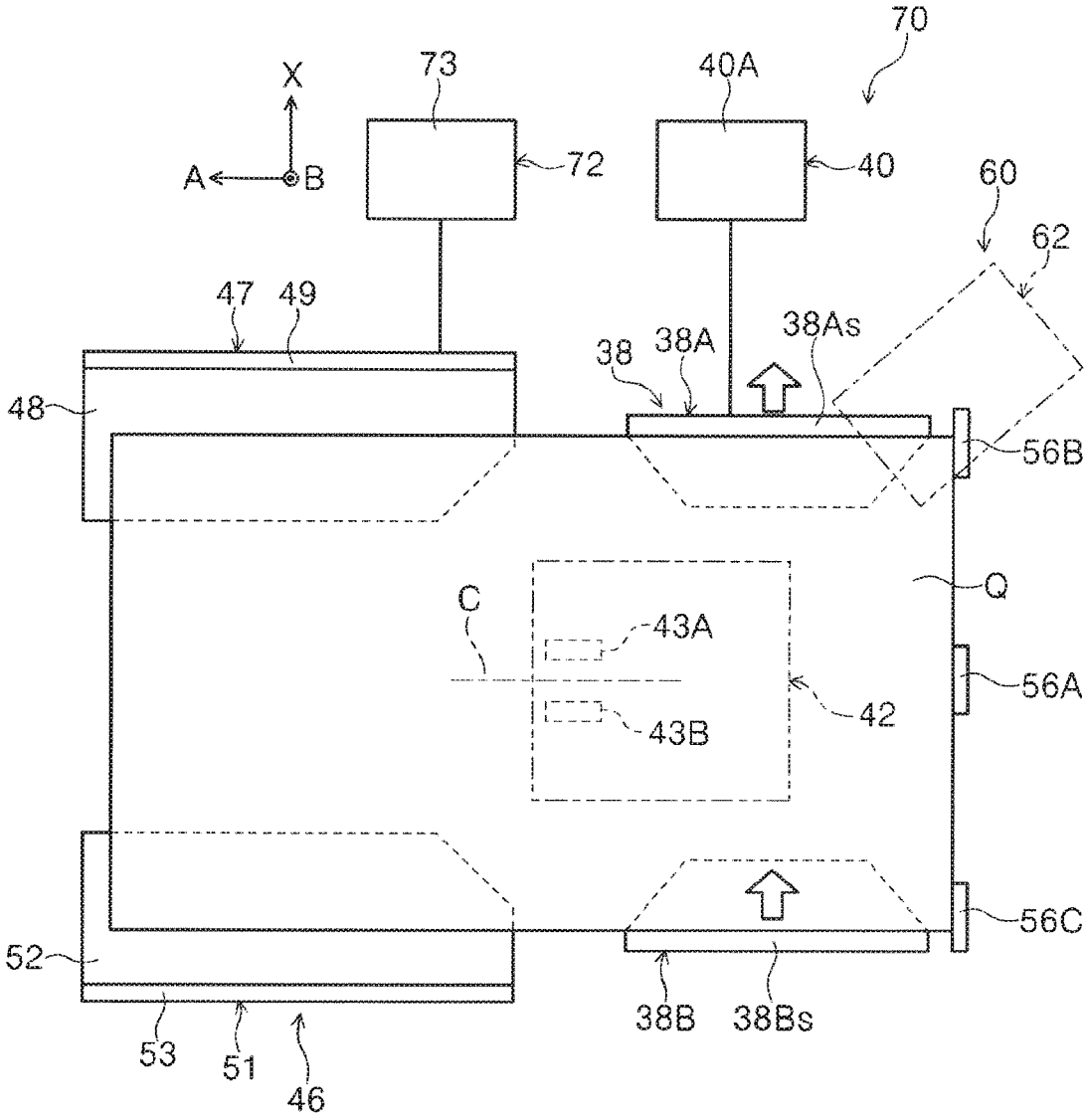
FIG. 11 is a diagram for explaining an operation in an embodiment 3.
Figure 12:
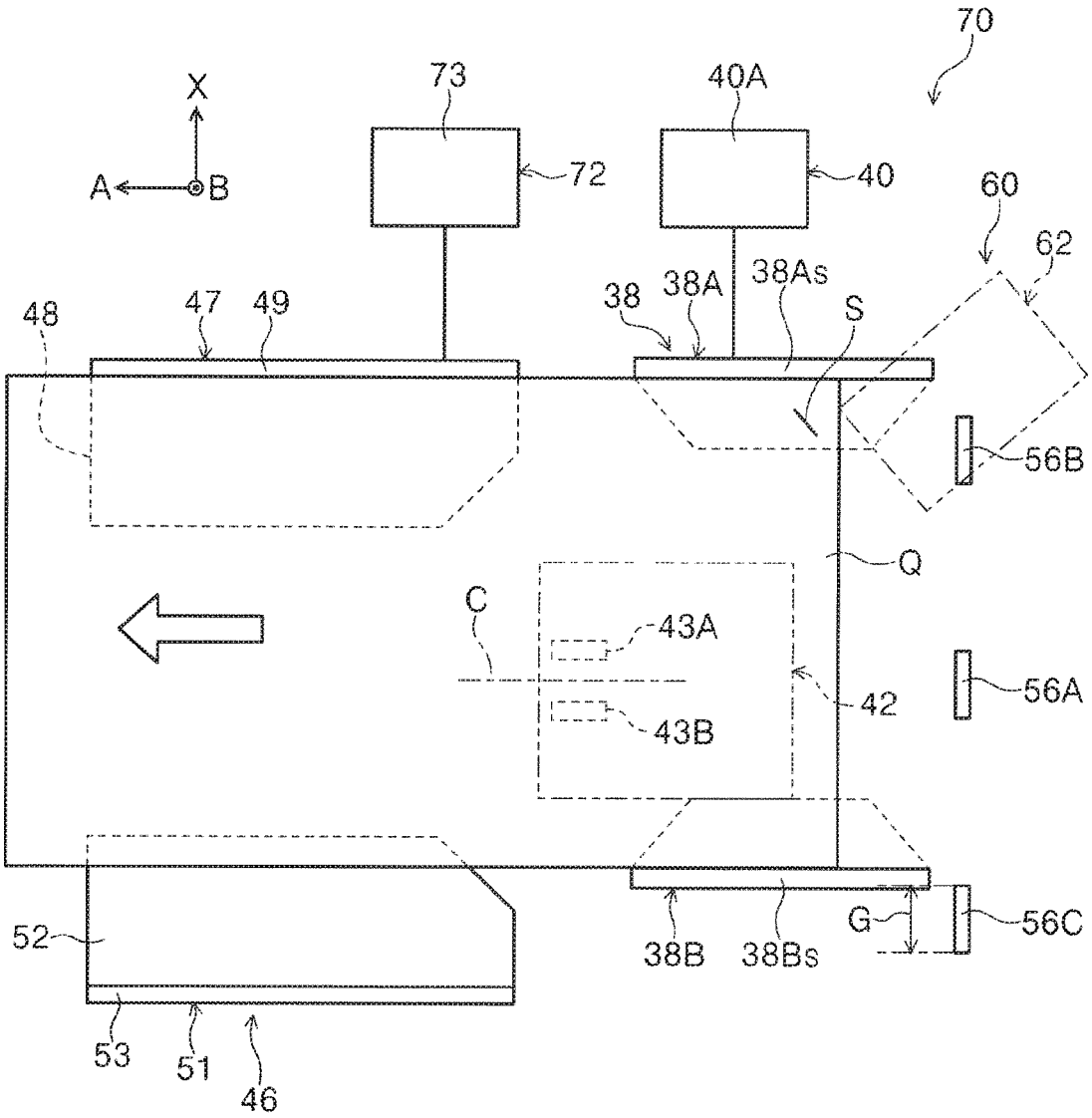
FIG. 12 is a diagram for explaining the operation in the embodiment 3.

As illustrated in FIG. 11, in the present embodiment 3 is different from the embodiment 2 in a point that, in the medium discharger 70, a positional relationship between the side cursor 38 and the alignment plate 56A, the alignment plate 56B, and the alignment plate 56C is set.

Specifically, the moving unit 40 is configured to move the media bundle Q to the X-axis direction so that the end portion of the media bundle Q in the X-axis direction after the movement is displaced with respect to the alignment plate 56C in the X-axis direction. In the embodiment 3, as an example, the positions of stapler 62 and the side cursor 38 are set so that the −X side end portion of the media bundle Q after being moved for staple processing is positioned at the +X side of a region G (FIG. 12) obtained by projecting the alignment plate 56C to the A-axis direction.

The CPU 26 is configured so as to count the number of rotations of the motor (not illustrated) in the cursor movement portion 40A, and determine whether or not the number of rotations exceeds a count reference number set in advance, and then, determine whether or not the side cursor 38 is positioned at the +X side of the region G described above.

Descriptions on Operation and Effects of Embodiment 3

The medium discharger 70, the post-processing unit 3 and the recording system 1 in the embodiment 3 will be described mainly with reference to FIG. 11, FIG. 12 and FIG. 13. FIG. 11 and FIG. 12 mainly illustrate the positional relationship between the side cursor 38, the side guide 46, the media bundle Q, the alignment plate 56A, the alignment plate 56B, and the alignment plate 56C as a schematic diagram. FIG. 13 is a flowchart illustrating a flow of the post-processing and the discharge processing performed on the media bundle Q by the controller 22 (FIG. 1). In the description using FIG. 13, the individual drawing number for the reference numerals of each member will be omitted.

Figure 13:
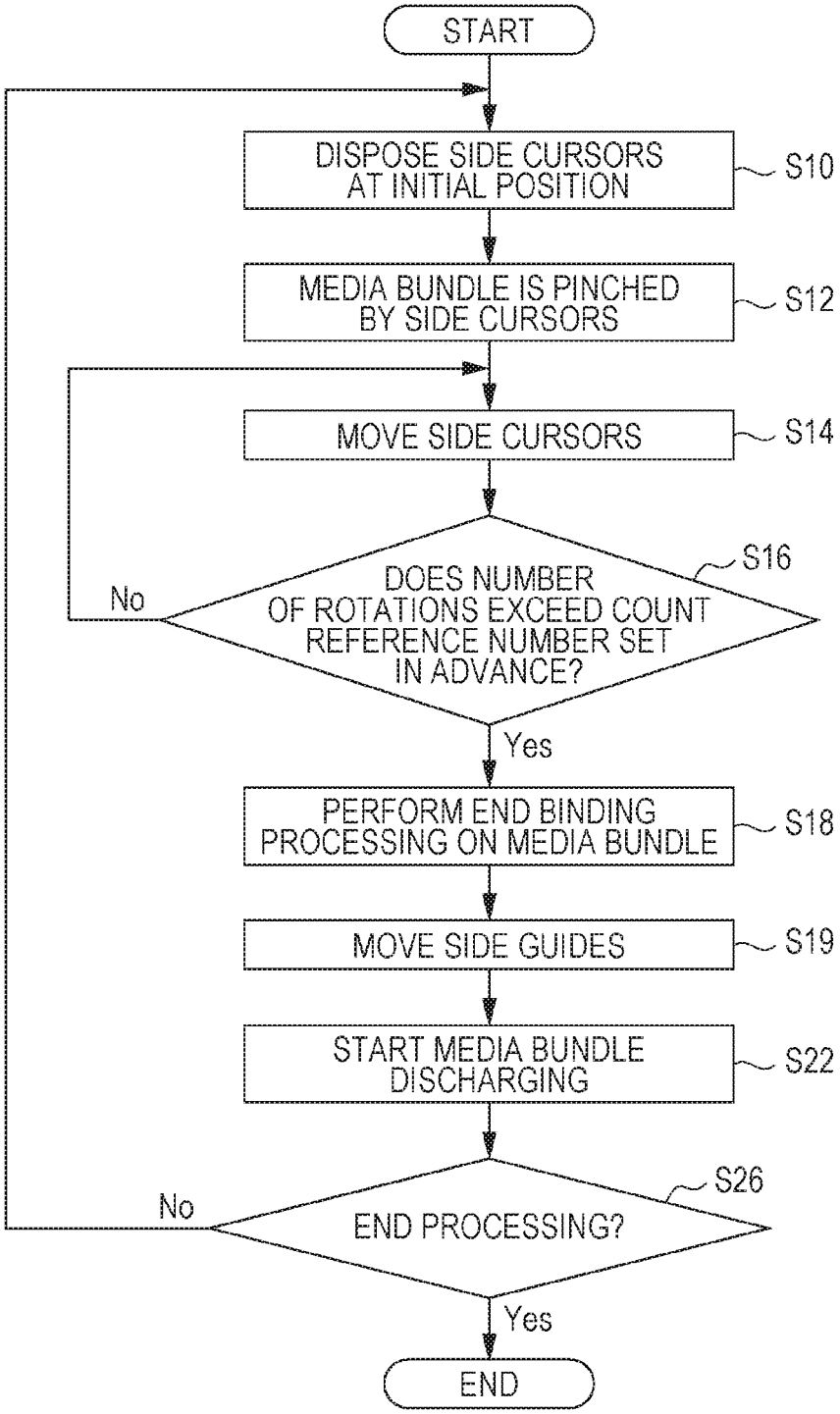
FIG. 13 is a flowchart of the embodiment 3.

Each processing illustrated in FIG. 13 is performed by the CPU 26 reading a processing program from the ROM or the storage, deploying the processing program in the RAM, and executing the processing program. Steps of the same operations as in the embodiment 1 or in the embodiment 2 are denoted by the same step reference numerals as in the embodiment 1 or in the embodiment 2, and the description thereof will be omitted. In addition, before performing the process in STEP S10, by a plurality of media P coming in contact with the alignment plate 56A, the alignment plate 56B and the alignment plate 56C, the end portion of a plurality of media P is aligned to form a media bundle Q (FIG. 11).

After STEP S14 ends, the process proceeds to STEP S16.

In STEP S16, the CPU 26 counts the number of rotations of the motor of the cursor movement portion 40A, and determines whether or not the number of rotations exceeds the count reference number set in advance. When the number of rotations exceeds the count reference number (Yes in STEP S16), the process proceeds to STEP S18. When the number of rotations is equal to or less than the count reference number (No in STEP S16), the process proceeds to STEP S14, and then, STEP S14 and STEP S16 are performed again.

As described above, according to embodiment 3, if the moving unit 40 moves the media bundle Q to the X-axis direction after aligning the end portion of the media bundle Q upstream in the A-axis direction using the alignment plate 56A, the alignment plate 56B and the alignment plate 56C, the end portion of the media bundle Q at the −X side in the X-axis direction is displaced to the +X side in the X-axis direction with respect to the alignment plate 56C. Since the contact portion of the media bundle Q with the alignment plate 56A and the alignment plate 56B are biased due to this "displacement", the media bundle Q tends to skew, but because the first side guide 47 restricts the movement of the media bundle Q to the X-axis direction, it is possible to suppress the skew of the media bundle Q.

Embodiment 4

Next, a medium discharging device, a post-processing device, and a recording apparatus according to an embodiment 4 of the present disclosure will be described based on FIGS. 14 to 16. The same reference numerals will be given to the same parts as those of the embodiment 1 to embodiment 3, and the description thereof will be omitted. In addition, the description of the operations and effects same as those in the embodiment 1 to embodiment 3 will be omitted.

Figure 14:
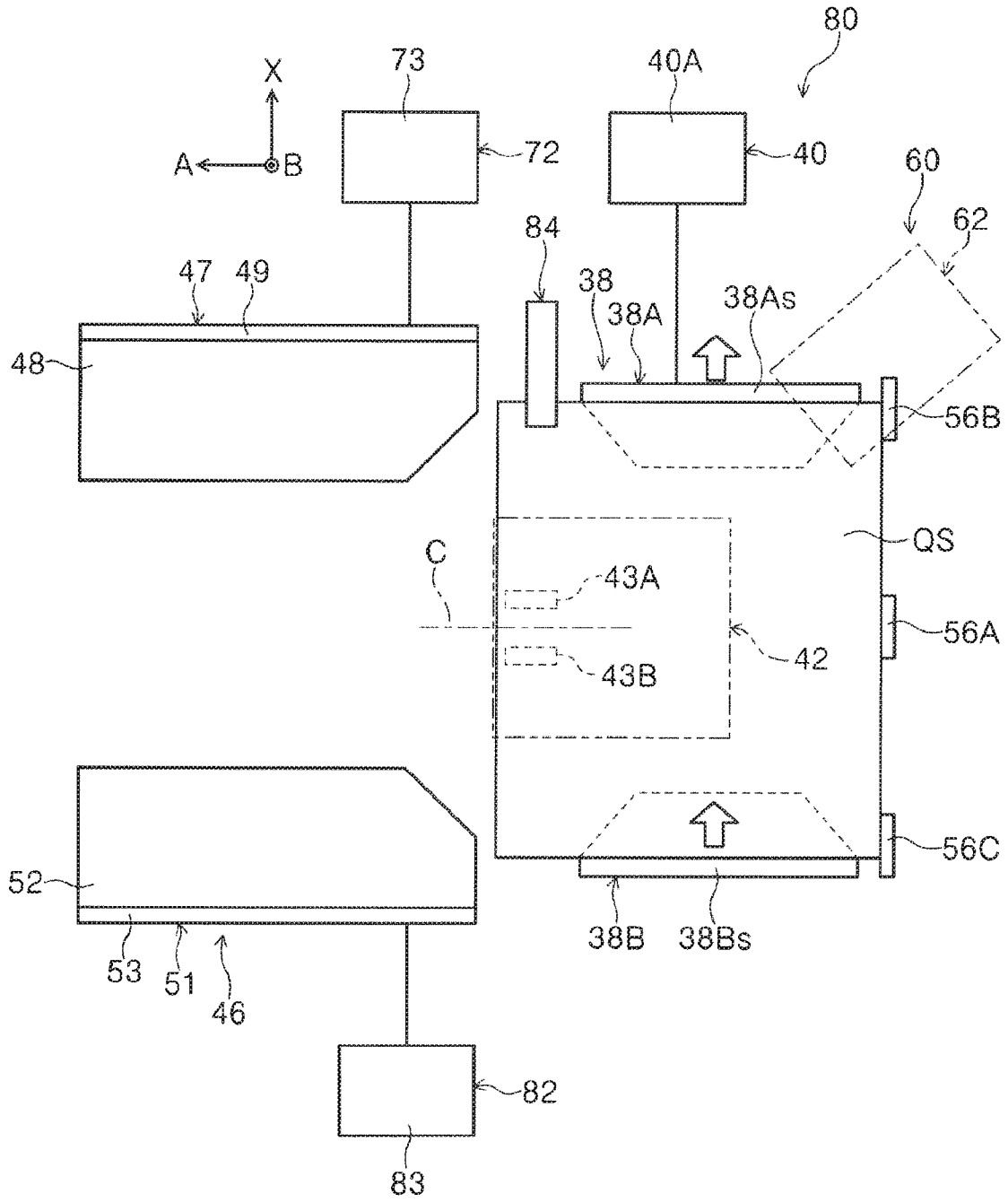
FIG. 14 is a diagram for explaining an operation in an embodiment 4.
Figure 15:
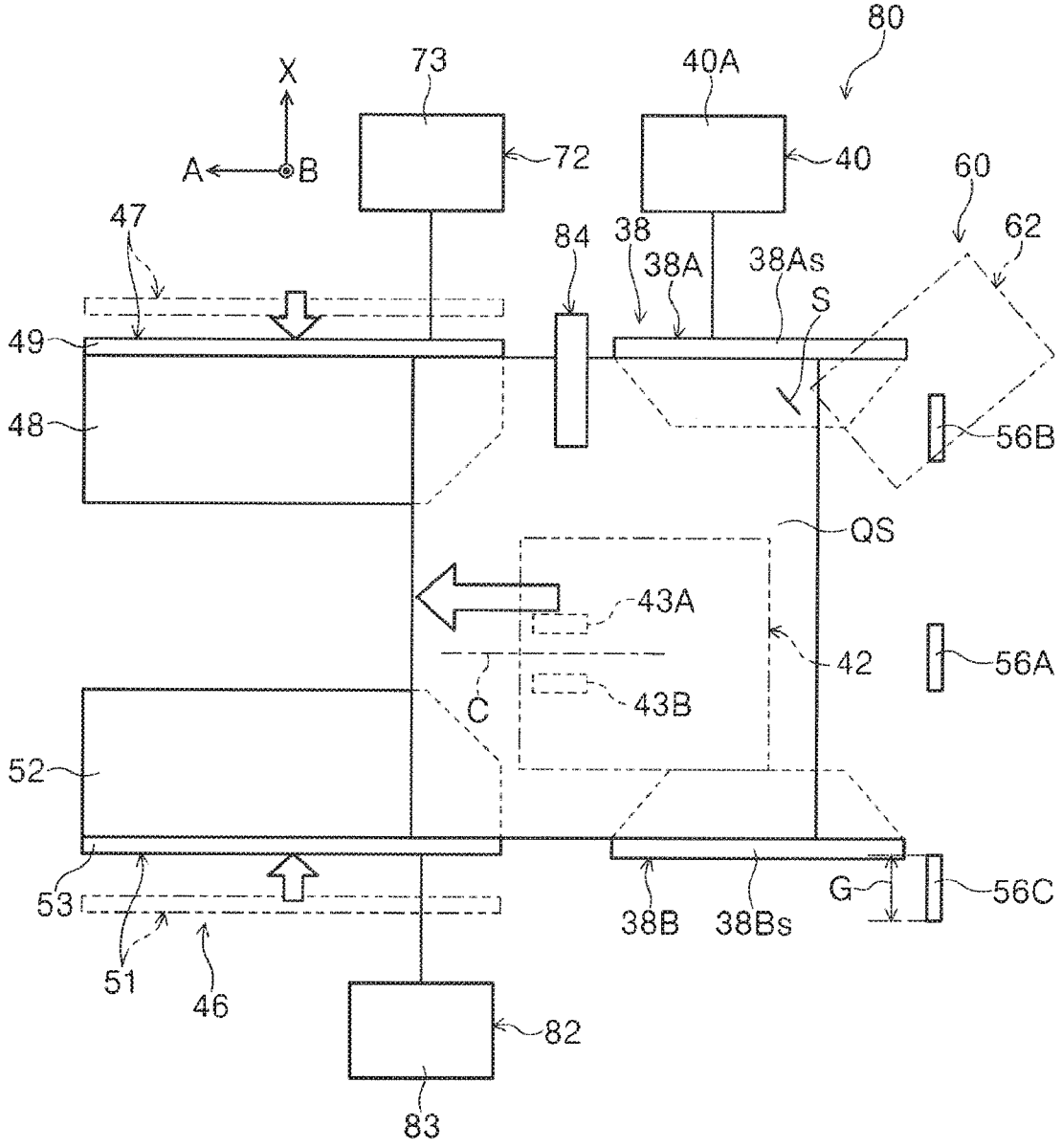
FIG. 15 is a diagram for explaining the operation in the embodiment 4.

As illustrated in FIG. 14, in the present embodiment 4, a medium discharger 80 is provided in place of the medium discharger 70 (FIG. 11) in the post-processing unit 3 (FIG. 1). The medium discharger 80 has a configuration in which a drive unit 82 and a medium position sensor 84 are added to the medium discharger 70. In present embodiment 4, as an example, a media bundle QS is formed.

The media bundle QS is composed of media P in which the length in the X-axis direction is the same as that of the media bundle Q and the length in the Y-axis direction is half that of the media bundle Q. Therefore, when the media bundle QS is placed on the processing tray 36 (FIG. 1), a tip portion of the media bundle QS at the +A side is not disposed in the region facing the side guide 46 and the X-axis direction.

In the medium discharger 80, each of the first side guide 47 and the second side guide 51 functions as an example of a restriction member.

The first side guide 47 is an example of the restriction member and a first restriction member, and is configured to come into contact with the end portion of the media bundle Q at one side (+X side) in the X-axis direction. In addition, the first side guide 47 supports the one side end portion of the media bundle Q by the support portion 48.

The second side guide 51 is an example of the restriction member and a second restriction member, and is configured to come into contact with the other side (−X side) end portion of the media bundle Q in the X-axis direction. In addition, the second side guide 51 supports the other end portion of the media bundle Q by the support portion 52.

The medium position sensor 84 is provided at a position at the +B side of the upper surface which is the +B side surface of the media bundle QS, and a position between the side cursor 38 and the side guide 46 in the A-axis direction, and a position facing the +X side end portion of the media bundle QS and the B-axis direction. In addition, medium position sensor 84 is configured as an optical sensor, for example, and detects the position of the end portion (side edge) of the media bundle QS depending on the presence or absence of light reflection.

As described above, the medium position sensor 84 detects the position of the end portion of the media bundle QS at the +X side in the X-axis direction.

The drive unit 82 is configured to include a guide driving portion 83 as an example of the driving portion, and a controller 22 (FIG. 1) that controls the driving of the guide driving portion 83. The guide driving portion 83 includes a motor and gears which are not illustrated.

In the drive unit 82, the CPU 26 (FIG. 1) controls the driving of the guide driving portion 83 based on the program set in the controller 22, and thus, the first side guide 47 is moved in the X-axis direction.

Specifically, the guide driving portion 83 is configured to operate interlocked with the guide driving portion 73. That is, when the guide driving portion 73 moves the first side guide 47 toward the −X side, the guide driving portion 83 moves the second side guide 51 toward the +X side.

In addition, the guide driving portion 73 and the guide driving portion 83 are configured to move the first side guide 47 and the second side guide 51 according to the position of the end portion of the media bundle QS detected by the medium position sensor 84. In other words, the guide driving portion 73 and the guide driving portion 83 are configured to move the first side guide 47 and the second side guide 51 according to the position of the end portion of the media bundle QS in the X-axis direction.

In addition, the guide driving portion 73 and the guide driving portion 83 are configured to drive the first side guide 47 and the second side guide 51 to approach close to the set position alongside the first cursor 38A and the second cursor 38B and the A-axis direction after the media bundle QS starts to be discharged by the discharge unit 42 and the +A side end portion of the media bundle QS in the A-axis direction reaches the −A side end portion position of the side guide 46 in the A-axis direction. The discharge start time of the media bundle QS is previously detected by the controller 22 based on the operation start time of the discharge unit 42.

Descriptions on Operation and Effects of Embodiment 4

The medium discharger 80, the post-processing unit 3 and the recording system 1 in the embodiment 4 will be described mainly with reference to FIG. 14, FIG. 15 and FIG. 16. FIG. 14 and FIG. 15 mainly illustrate the positional relationship between the side cursor 38, the side guide 46, the media bundle QS, the alignment plate 56A, the alignment plate 56B, and the alignment plate 56C, as a schematic diagram. FIG. 16 is a flowchart illustrating a flow of the post-processing and the discharge processing performed on the media bundle QS by the controller 22 (FIG. 1). In the description using FIG. 16, the individual drawing number for the reference numerals of each member will be omitted.

Figure 16:
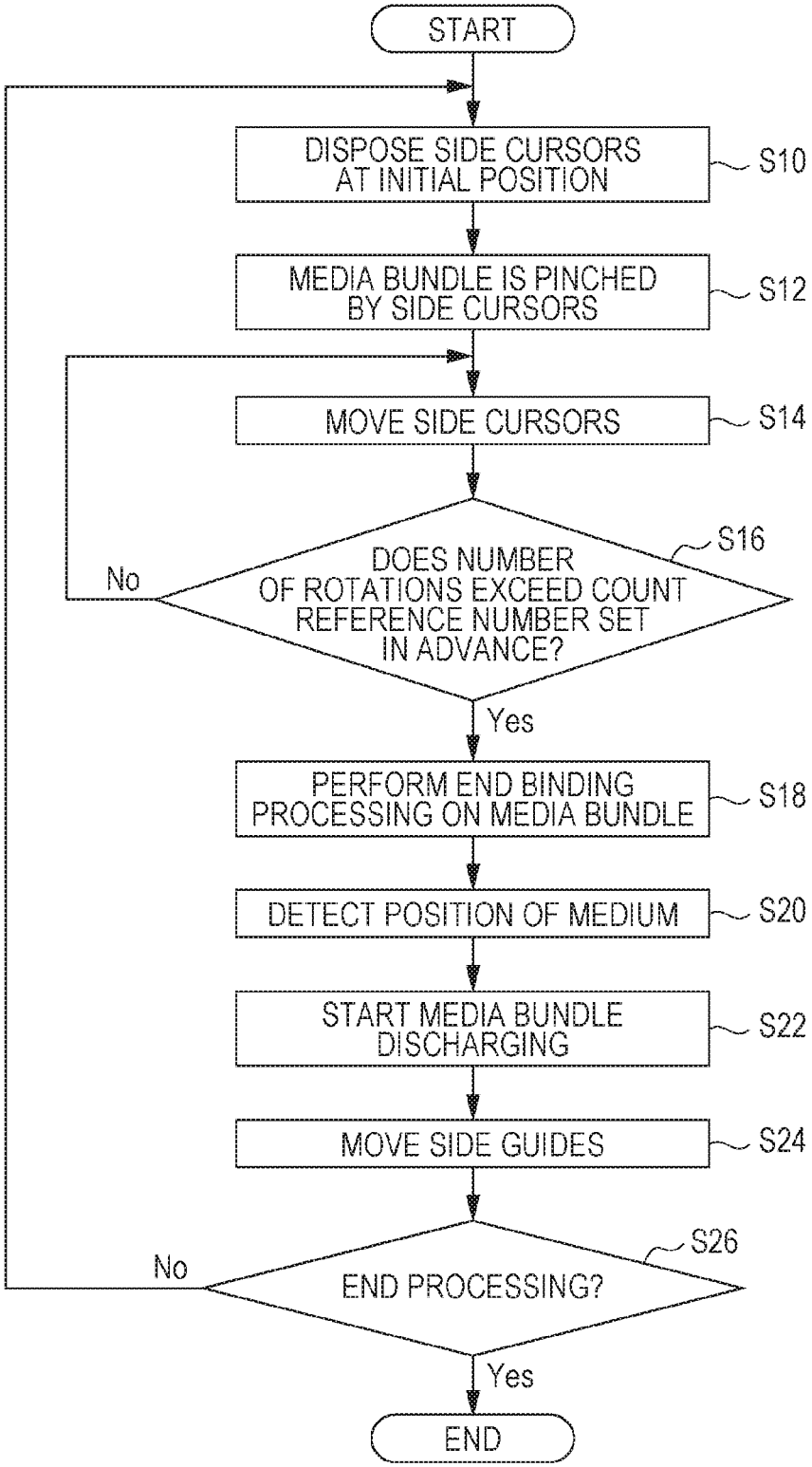
FIG. 16 is a flowchart of the embodiment 4.

Each processing illustrated in FIG. 16 is performed by the CPU 26 reading a processing program from the ROM or the storage, deploying the processing program in the RAM, and executing the processing program. Steps of the same operations as in the embodiment 1 to the embodiment 3 are denoted by the same step reference numerals as in the embodiment 1 to the embodiment 3 and the description thereof will be omitted. In addition, before performing the process in STEP S10, by a plurality of media having a size of half the medium P coming in contact with the alignment plate 56A, the alignment plate 56B and the alignment plate 56C, the end portion of the plurality of media is aligned to form the media bundle QS (FIG. 14).

After STEP S18 ends, the process proceeds to STEP S20.

In STEP S20, the CPU 26 detects the medium position of the media bundle QS (the position of the end portion at the +X side) based on the result of detection performed by the medium position sensor 84 (FIG. 14). Then, the process proceeds to STEP S22.

In STEP S22, the CPU 26 operates the discharge unit 42 to start discharging the media bundle QS. Then, the process proceeds to STEP S24.

In STEP S24, the CPU 26 operates the guide driving portion 73 and the guide driving portion 83 to move the first side guide 47 and the second side guide 51 to the set position from the initial position. As a result, the side plate portion 38As and the vertical wall portion 49 are disposed at the same position in the X-axis direction, and the side plate portion 38Bs and the vertical wall portion 53 are disposed at the same position in the X-axis direction (FIG. 15). Then, the process proceeds to STEP S26.

In the media bundle QS during discharge, since the movement in the X-axis direction is restricted by the vertical wall portion 49 and the vertical wall portion 53, the skew can be suppressed.

1. As described above, according to embodiment 4, when using the media bundle QS having a relatively short length in the A-axis direction, the side guide 46 is moved so that the guide driving portion 73 and the guide driving portion 83 are aligned the side cursor 38 after the discharge of the media bundle QS is started and the +A side end portion of the media bundle QS in the A-axis direction reaches the −A side end portion position of the side guide 46 in the A-axis direction. In this way, since it becomes difficult for the downstream end portion of the short media bundle QS in the A-axis direction to be caught in the −A side end portion which is a part of the side guide 46, it is possible to suppress the defective discharge of the media bundle QS compared to the configuration in which the side guide 46 is aligned with the side cursor 38 before the discharge of the media bundle QS.

2. According to embodiment 4, since the guide driving portion 73 and the guide driving portion 83 move the side guide 46 according to the position of the end portion of the media bundle QS, the side guide 46 can be disposed along the side edge of the media bundle QS. In this way, a gap is less likely to occur between the discharged media bundle QS and the side guide 46, it is possible to further suppress the skew of the media bundle QS.

3. According to the embodiment 4, since the first side guide 47 and the second side guide 51 are in contact with the portions at both sides of the media bundle QS in the X-axis direction, and the displacement of the media bundle QS in the X-axis direction is restricted, and thus, it is possible to suppress the skew of the media bundle QS compared to the configuration without any one of the first side guide 47 and the second side guide 51.

Other Embodiment

The medium dischargers 30, 70, 80, the post-processing unit 3 and the recording system 1 relating to the embodiments of the present disclosure basically have the configurations described above, however, partial change or omission of the configuration can be performed within the range of not departing from the scope of the present disclosure.

The recording system 1 is not limited to the ink jet type and may be an electro-photographic type.

The post-processing by the post-processing unit 3 is not limited to the end binding processing using the stapler 62, but, for example, may be the punching processing for punching the medium P to make a hole with a punch, the folding process for folding the medium P, and the saddle stitching for saddle stitching the medium P.

In the medium discharger 80, instead of the first cursor 38A, a side wall standing upright on the peripheral edge of the processing tray 36 may be provided, and the media bundle Q may be moved by moving the second cursor 38B toward the side wall. When moving the media bundle Q, not only the +X side of the media bundle Q but also the −X side thereof may be moved.

In addition, the moving unit 40 may move the media bundle Q so that the −X side end portion of the media bundle Q is aligned in the A-axis direction with respect to the alignment plate 56C.

In addition, without providing the drive unit 72 and the drive unit 82, the side guide 46 may be fixed or the side guide 46 may be manually moved.

In addition, when it is the media bundle Q that is discharged, the drive unit 72 and the drive unit 82 may be moved to the set position before the media bundle Q is discharged.

In addition, the side guide 46 may be driven based on the positions of the first cursor 38A and the second cursor 38B, for example, without using the medium position sensor 84.

In addition, the side guide 46 may not include the support portion 48 and the support portion 52.

In addition, the side guide 46 may be any one the first side guide 47 or the second side guide 51.

In addition, when the media bundle QS is moved to the stapling position, the center portion of the media bundle QS in the X-axis direction and the center portion of the discharge unit 42 in the X-axis direction may be disposed so as to be aligned with the B-axis direction.

As a modification example, when the moving unit 40 moves the side cursor 38 to the X-axis direction, the vertical wall portion 49 and the support portion 48 of the first side guide 47 may be movable in the X-axis direction interlocked with the movement of the side cursor 38 by using the drive unit 72.

Similarly, the vertical wall portion 53 and the support portion 52 of the second side guide 51 may also be interlocked with the side cursor 38 by using the drive unit 82 together with the vertical wall portion 49 and the support portion 48 of the first side guide 47.

1. According to the modification example described above, when the moving unit 40 moves the side cursor 38 to the X-axis direction, since the vertical wall portion 49 and the support portion 48 can be moved in the same direction as the side cursor 38, it is possible to prevent the posture of the media bundle Q from tilting when moving in the X-axis direction.

2. In addition, according to the modification example described above, when the moving unit 40 moves the side cursor 38 to the X-axis direction, the vertical wall portions 49 and 53 and the support portions 48 and 52 are movable in the X-axis direction interlocked with the movement of the side cursor 38. In this way, when the side cursor 38 moves the media bundle Q sent to the processing tray 36 to the X-axis direction, if the tip side (+Y side) of the media bundle Q in the A-axis direction has a length that can be supported by the support portions 48 and 52, since the vertical wall portions 49 and 53 and the support portions 48 and 52 are also moved to the X-axis direction interlocked with the movement of the side cursor 38, it becomes possible to perform the shift movement of the media bundle Q in the X-axis direction in a state in which the posture of the media bundle Q is less likely to be disturbed.

Then, after the shift movement performed as described above, since the media bundle Q is discharged to the A-axis direction while being restricted from moving to the X-axis direction by the vertical wall portions 49 and 53, and discharged from the processing tray 36 onto the support portions 48 and 52, it is possible to suppress the skew of the media bundle Q.

By changing the support state of the media bundle Q by the support portions 48 and 52 to the non-support state and dropping the media bundle Q onto the discharge tray 41, it is possible to suppress the position of the media bundle Q placed in the discharge tray 41 from being displaced.

The side cursor 38 may not include the bottom plate portion 38Ab and the bottom plate portion 38Bb. In addition, in the side cursor 38, the number of surfaces coming in contact with the side surface of the media bundle Q and the media bundle QS in the X-axis direction may be either single or plural.

The moving unit 40 and the side guide 46 may not only those perform driving using the motor and gears, but also may perform driving drive using an electromagnetic linear actuator, for example. In addition, not limited to the electric type, but may be a hydraulic type or a pneumatic type.

The discharge unit 42 is not limited to be configured to include the pair of delivery rollers 43 and the paddle 44, but for example, may be configured to discharge the media bundle Q to the discharge tray 41 by circularly moving a belt having intake holes and sucking the air using the intake fan, and then, adsorbing and transporting the media bundle Q. In addition, the pair of delivery rollers 43 and the paddle 44 may not be provide.

In the medium discharger 80, without using the medium position sensor 84, the position of the side surface at the +X side of the media bundle QS may be obtained by a calculation, and then, the first side guide 47 may be disposed so that the side surface of the media bundle QS at the +X side and the side surface of the vertical wall portion 49 at the −X side are aligned in the A-axis direction. The position of the side surface of the media bundle QS at the +X side may be obtained according to an amount of movement of the media bundle QS, for example, by previously obtaining the amount of movement of the side cursor 38 in the X-axis direction and the position of the side surface of the media bundle QS at the +X side in association with each other using the arithmetic expression.

As a reference example, even in a configuration without the moving unit 40 or in the configuration with the moving unit 40, without moving the media bundle Q or in a configuration where the media bundle Q is moved, the post-processing is performed and moved to return to the center, and then, discharged at the center, after performing the end binding processing on the +X side and −Y side corners of the media bundle Q in the processing tray 36, the side surface of the vertical wall portion 49 at the −X side in the first side guide 47 may be disposed so as to be aligned with the side surface of the first cursor 38A at the −X side in the A-axis direction, and then, the skew of the discharged media bundle Q may be suppressed by the first side guide 47.

What is claimed is:

1. A medium discharging device comprising:

a guide member that is movably, in an intersecting direction, provided in an accumulation portion in which a plurality of media are accumulated, the intersecting direction intersecting a discharging direction in which the media are discharged from the accumulation portion, aligns an end portion of a media bundle in the intersecting direction, the media bundle being made of the plurality of media, and guides the media bundle in the discharging direction when the media bundle is discharged;

a movement portion that moves the guide member in the intersecting direction;

a discharger that discharges the media bundle from the accumulation portion to a placement portion where the media bundle is placed;

a restriction member that is disposed downstream in the discharging direction with respect to the accumulation portion, is disposed alongside the guide member in the discharging direction when the media bundle is discharged, and restricts movement of the media bundle in the intersecting direction, the media bundle being discharged by the discharger; and a driving portion that moves the restriction member in the intersecting direction, wherein the driving portion performs driving for causing the restriction member to approach a set position at which the restriction member is positioned alongside the guide member after the discharger starts to discharge the media bundle and an end portion of the media bundle downstream in the discharging direction reaches a position of an end portion of the restriction member, the position being upstream in the discharging direction.

2. The medium discharging device according to claim 1, wherein the guide member is provided on one side and an other side in the intersecting direction with respect to the media bundle.

3. The medium discharging device according to claim 1, wherein the accumulation portion is provided with a plurality of aligning members that are arranged at an interval in the intersecting direction and align an end portion of the media bundle upstream in the discharging direction, and the movement portion moves the media bundle in the intersecting direction by moving the guide member so that the end portion of the media bundle in the intersecting direction is displaced from any of the aligning members in the intersecting direction.

4. The medium discharging device according to claim 1, wherein the driving portion moves the restriction member according to a position of the end portion of the media bundle in the intersecting direction.

5. The medium discharging device according to claim 1, wherein the restriction member is provided with a support portion that supports the media bundle from below.

6. A medium discharging device comprising:

a guide member that is movably, in an intersecting direction, provided in an accumulation portion in which a plurality of media are accumulated, the intersecting direction intersecting a discharging direction in which the media are discharged from the accumulation portion, aligns an end portion of a media bundle in the intersecting direction, the media bundle being made of the plurality of media, and guides the media bundle in the discharging direction when the media bundle is discharged;

a movement portion that moves the guide member in the intersecting direction;

a discharger that discharges the media bundle from the accumulation portion to a placement portion where the media bundle is placed; and a restriction member that is disposed downstream in the discharging direction with respect to the accumulation portion, is disposed alongside the guide member in the discharging direction when the media bundle is discharged, and restricts movement of the media bundle in the intersecting direction, the media bundle being discharged by the discharger, wherein the restriction member is provided with a support portion that supports the media bundle from below, the support portion is positioned above the placement portion, when the movement portion moves the guide member in the intersecting direction, the restriction member and the support portion are configured to move in the intersecting direction by the driving portion interlocked with movement of the guide member, and the driving portion changes a support state of the media by the support portion to a non-support state after the media bundle is discharged from the accumulation portion onto the support portion, and drops the media bundle onto the placement portion.

7. The medium discharging device according to claim 1, wherein the restriction member includes a first restriction member that comes in contact with one end portion of the media bundle in the intersecting direction and a second restriction member that comes in contact with an other end portion of the media bundle in the intersecting direction.

8. The medium discharging device according to claim 1, wherein the restriction member is disposed so as to come in contact with a side edge of the media bundle opposite to a side of the discharger with respect to a center of the media bundle in the intersecting direction after movement of the guide member by the movement portion.

9. A post-processing device comprising:

the medium discharging device according to claim 1; and a post-processor that is provided in the accumulation portion of the medium discharging device and performs post-processing on the media bundle in the accumulation portion, wherein the movement portion moves the media bundle to one side in the intersecting direction by moving the guide member, and the post-processor performs binding processing on an end portion on the one side of the media bundle that was moved to the one side.

10. A recording apparatus comprising:

a recording portion that records information on a medium; and the post-processing device according to claim 9 that accumulates a plurality of the media where the information is recorded by the recording portion in the accumulation portion to form the media bundle, and performs the post-processing on the media bundle.

11. A medium discharging device comprising:

a guide member that is movably, in an intersecting direction, provided in an accumulation portion in which a plurality of media are accumulated, the intersecting direction intersecting a discharging direction in which the media are discharged from the accumulation portion, aligns an end portion of a media bundle in the intersecting direction, the media bundle being made of the plurality of media, and guides the media bundle in the discharging direction when the media bundle is discharged;

a movement portion that moves the guide member in the intersecting direction;

a discharger that discharges the media bundle from the accumulation portion to a placement portion where the media bundle is placed; and a restriction member that is disposed downstream in the discharging direction with respect to the accumulation portion, is disposed alongside the guide member in the discharging direction when the media bundle is discharged, and restricts movement of the media bundle in the intersecting direction, the media bundle being discharged by the discharger; and a driving portion that moves the restriction member in the intersecting direction, wherein the driving portion performs driving for causing the restriction member to approach a position at which the restriction member is positioned alongside the guide member after the discharger starts to discharge the media bundle to the placement portion.

* * * * *